US011720039B2

(12) United States Patent
Kobayashi

(10) Patent No.: US 11,720,039 B2
(45) Date of Patent: Aug. 8, 2023

(54) IMAGE FORMING APPARATUS

(71) Applicant: CANON KABUSHIKI KAISHA, Tokyo (JP)

(72) Inventor: Takanori Kobayashi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/859,976

(22) Filed: Jul. 7, 2022

(65) Prior Publication Data

US 2023/0016411 A1 Jan. 19, 2023

(30) Foreign Application Priority Data

Jul. 13, 2021 (JP) ..... 2021-115511

(51) Int. Cl.
*G03G 15/20* (2006.01)

(52) U.S. Cl.
CPC ..... *G03G 15/2028* (2013.01); *G03G 15/2064* (2013.01); *G03G 2215/2038* (2013.01)

(58) Field of Classification Search
CPC ..... G03G 2215/00143
See application file for complete search history.

(56) References Cited

U.S. PATENT DOCUMENTS 5,027,160 A * 6/1991 Okada ..... G03G 15/2003 399/329
5,887,236 A * 3/1999 Hirao ..... G03G 15/2032 399/328
2009/0317108 A1* 12/2009 Taki ..... G03G 15/1605 399/66
2018/0257885 A1* 9/2018 Nakajima ..... B65H 5/026

FOREIGN PATENT DOCUMENTS

JP 2015-059964 A 3/2015

* cited by examiner

*Primary Examiner* — Sevan A Aydin
(74) *Attorney, Agent, or Firm* — Canon U.S.A., Inc. I.P. Division

(57) ABSTRACT

An image forming apparatus includes a fixing belt, a steering roller, a pressure rotation member, and a control unit. The pressure rotation member forms a nip portion with the fixing belt to convey a recording material. In continuously performing fixing on recording materials, the control unit controls the steering roller such that a distance between a center position of the fixing belt when an operation to tilt the steering roller is performed for a first time after the center position is moved away from a center position of a moving range of the fixing belt and the center position of the moving range is smaller in a period after a last but one recording material before the pressure rotation member enters a separated state from the fixing belt passes through the nip portion than in a period before the recording material passes through the nip portion.

7 Claims, 15 Drawing Sheets

| FIRST SENSOR 394 | SECOND SENSOR 395 | THIRD SENSOR 396 | BELT POSITION |
|---|---|---|---|
| 0 | 0 | 0 | FIRST FULL DEVIATION |
| 1 | 0 | 0 | NEAR 3 |
| 1 | 1 | 0 | NEAR 2 |
| 0 | 1 | 0 | NEAR 1 |
| 0 | 1 | 1 | CENTER |
| 1 | 1 | 1 | FAR 1 |
| 1 | 0 | 1 | FAR 2 |
| 0 | 0 | 1 | FAR 3 |
| 0 | 0 | 0 | SECOND FULL DEVIATION |

SENSOR BLOCKED: 0 SENSOR OPEN: 1

FIG.15

| BELT POSITION | ASSIGNED VALUE |
|---|---|
| FIRST FULL DEVIATION | — |
| NEAR 3 | 1 |
| NEAR 2 | 2 |
| NEAR 1 | 3 |
| CENTER | 4 |
| FAR 1 | 5 |
| FAR 2 | 6 |
| FAR 3 | 7 |
| SECOND FULL DEVIATION | — |

IMAGE FORMING APPARATUS

BACKGROUND

Field

The present disclosure relates to an image forming apparatus that can form an image on a recording material.

Description of the Related Art

An image forming apparatus includes a fixing apparatus that fixes a toner image on a recording material to the recording material.

The fixing apparatus includes a fixing belt that applies heat to unfixed toner, and a pressure rotation member that presses the fixing belt to form a fixing nip portion and is driven to rotate. The fixing belt makes contact with the pressure rotation member at the fixing nip portion, and is driven and rotated by the rotational drive of the pressure rotation member. If a recording material bearing an unfixed toner image is conveyed to the fixing nip portion, the heat from the fixing belt and pressure from the pressure rotation member are applied to the recording material, whereby the unfixed toner is fixed to the recording material. The image forming apparatus also includes a contact-separation mechanism. The contact-separation mechanism moves the pressure rotation member to a position where the pressure rotation member makes contact with the fixing belt (contact state) and a position where the pressure rotation member is separated from the fixing belt (separated state). The pressure rotation member can be cooled by separating the pressure rotation member from the fixing belt.

Japanese Patent Application Laid-Open No. 2015-59964 discusses a steering control to reciprocate a fixing belt in a width direction. Reciprocating the fixing belt repeatedly within a predetermined area can reduce repetitive passing of the edges of recording materials over the same area of the fixing belt.

Deterioration to the surface of the fixing belt can thereby be reduced.

To prevent an excessive temperature increase at the surface of the pressure rotation member, the pressure rotation member has heretofore been brought into the separated state during a non-sheet passing state where no recording material is conveyed to the fixing nip portion.

The steering control can reduce repetitive passing of the edges of recording materials over the same area of the fixing belt. Deterioration to the surface of the fixing belt can thus be reduced. However, if the pressure rotation member transitions from the contact state to the separated state during the non-sheet passing state, the fixing belt is released from the pressure from the pressure rotation member, and the moving speed of the fixing belt in the width direction increases. Conventionally, there has been a concern that the fixing belt can be fully deviated to either end of a steering roller.

SUMMARY

According to an aspect of the present disclosure, an image forming apparatus includes a fixing belt that is rotatable and endless, a heating roller configured to make contact with an inner peripheral surface of the fixing belt and apply heat to the fixing belt, a steering roller configured to make contact with the inner peripheral surface of the fixing belt along with the heating roller, a pressure rotation member configured to press the fixing belt, wherein the pressure rotation member and the fixing belt are configured to form a nip portion and sandwich and convey a recording material, bearing unfixed toner, to the nip portion to fix an unfixed toner image to the recording material, a contact-separation mechanism configured to move the pressure rotation member to a position where the pressure rotation member is in a contact state with the fixing belt and a position where the pressure rotation member is in a separated state from the fixing belt, a belt position detection unit configured to detect a position of the fixing belt in a width direction of the fixing belt, and a control unit configured to control swing of the steering roller such that the fixing belt is moved to a predetermined position in the width direction of the fixing belt based on a detection result of the belt position detection unit, wherein, in continuously performing fixing on a plurality of recording materials, the control unit is configured to control the steering roller such that a distance between a center position of the fixing belt in the width direction of the fixing belt when an operation to tilt the steering roller is performed for a first time after the center position of the fixing belt is moved away from a center position of a moving range of the fixing belt and the center position of the moving range of the fixing belt is smaller in a period after a last but one recording material before the pressure rotation member enters the separated state passes through the nip portion than in a period before the recording material passes through the nip portion.

Further features of the present disclosure will become apparent from the following description of exemplary embodiments with reference to the attached drawings.

BRIEF DESCRIPTION OF THE DRAWINGS

FIG. 15 is a table illustrating a relationship between belt positions and assigned values according to the first exemplary embodiment.

DESCRIPTION OF THE EMBODIMENTS

<Image Forming Apparatus>

Figure 1:
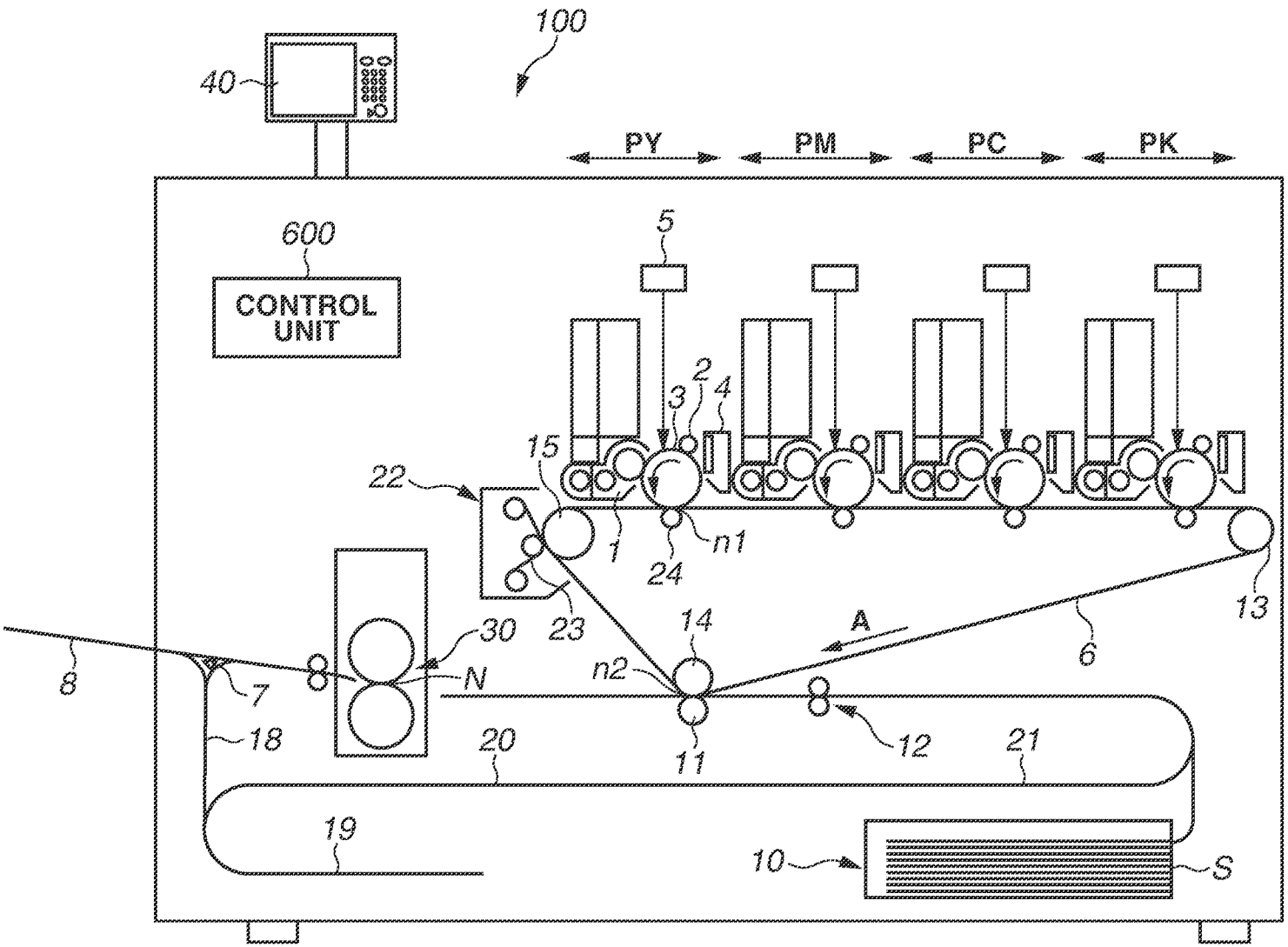
FIG. 1 is a schematic diagram illustrating a configuration of an image forming apparatus.

FIG. 1 is a schematic diagram illustrating a configuration of an image forming apparatus 100. As illustrated in FIG. 1, the image forming apparatus 100 includes four types of image forming units PY, PM, PC, and PK for yellow, magenta, cyan, and black, respectively, arranged along a moving direction of an intermediate transfer belt 6. The process of forming a toner image on the intermediate transfer belt 6 will be described by using the yellow image forming unit PY as an example.

The surface of a photosensitive drum 3 driven to rotate is uniformly charged by a charging device 2 (charging). An exposure device 5 then irradiates the surface of the photosensitive drum 3 with a laser beam based on input image data, whereby an electrostatic latent image is formed on the surface of the photosensitive drum 3 (exposure). A developing device 1 then forms a yellow toner image on the photosensitive drum 3 (development). A primary transfer roller 24 applies a voltage of opposite polarity to that of the potential of the yellow toner image to the intermediate transfer belt 6. The yellow toner on the photosensitive drum 3 is thereby transferred (primary transfer) to the intermediate transfer belt 6. Yellow toner left untransferred on the surface of the photosensitive drum 3 is scraped off by a toner cleaner 4 and removed from the surface of the photosensitive drum 3. Such a series of processes is similarly performed in the magenta image forming unit PM, the cyan image forming unit PC, and the black image forming unit PK. As a result, a full-color toner image is formed on the intermediate transfer belt 6.

The toner image on the intermediate transfer belt 6 is conveyed to a secondary transfer portion n2 formed by a pair of secondary transfer rollers 11 and 14. Recording materials S are taken out from a recording material cassette 10 one by one, and fed to the secondary transfer portion n2 in synchronization with the conveyance timing of the toner image. The toner image on the intermediate transfer belt 6 is transferred (secondary transfer) to the fed recording material S.

The recording material S to which the toner image is transferred is conveyed to a fixing apparatus 30. The toner image is fixed to the recording material S by heat and pressure (fixing) in the fixing apparatus 30. The recording material S to which the toner image is fixed is discharged to a sheet discharge tray 8.

The image forming apparatus 100 can also form a monochrome image. In forming a monochrome image, only the black image forming unit PK among the plurality of image forming units is driven.

Two-sided printing for forming images on both sides of a recording material S will now be described. A recording material S having an image formed on one side is discharged from the fixing apparatus 30 and then guided to a sheet path 18 by a flapper 7. The recording material S is conveyed from the sheet path 18 to a reversing path 19, and switched back on the reversing path 19. The recording material S is then passed through a two-sided path 20 and conveyed to a sheet path 21. The recording material S here is in a reversed state. The recording material S is then conveyed to the secondary transfer portion n2 again, and a toner image is transferred thereto. The toner image is fixed by the fixing apparatus 30. The two-sided-printed recording material S is then discharged to the sheet discharge tray 8.

The series of processes from the charging to the discharge of the toner image-fixed recording material S to the sheet discharge tray 8 will be referred to as image formation processing (print job). The period in which image formation is performed will be referred to as during image formation processing (during a print job).

<Fixing Apparatus>

Figure 2:
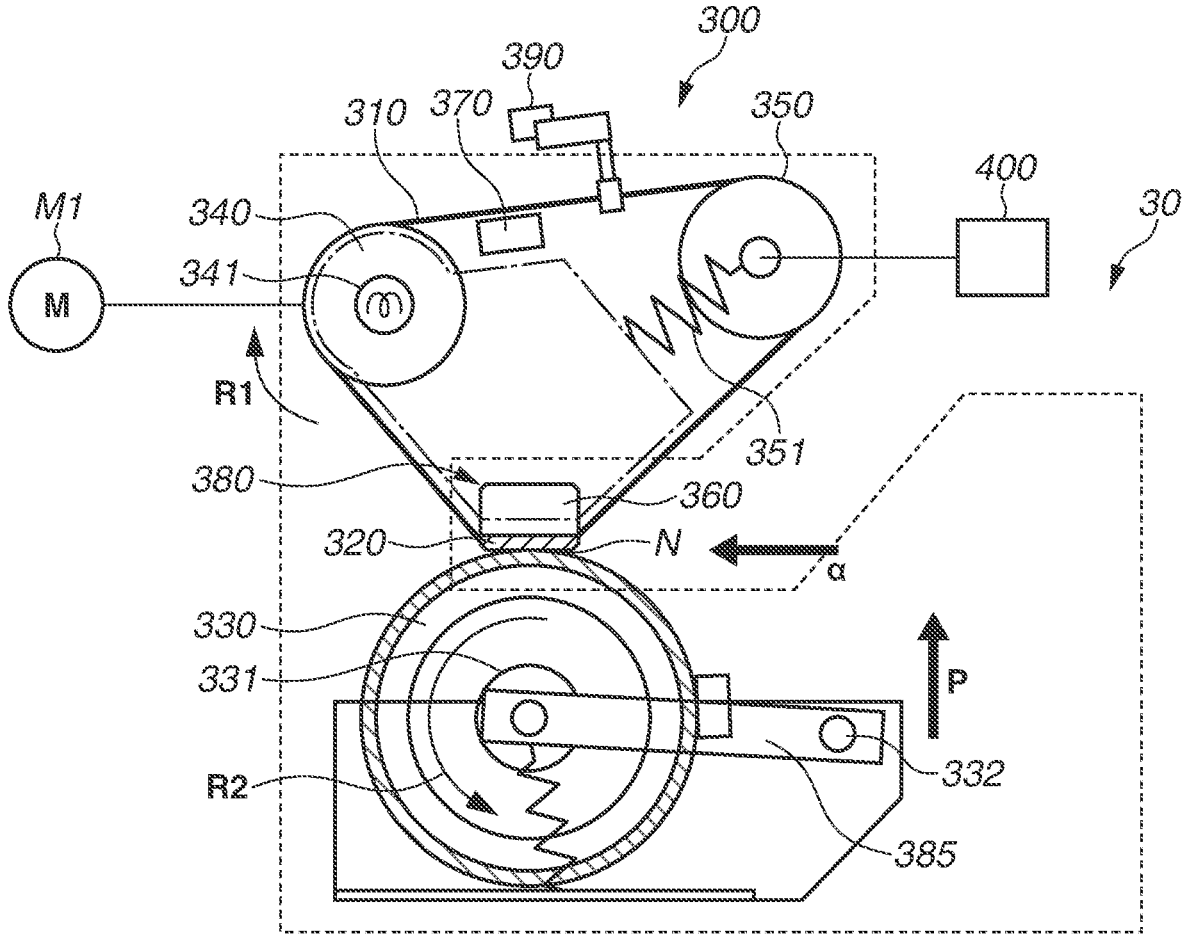
FIG. 2 is a schematic sectional view of a fixing apparatus.

Next, the fixing apparatus 30 according to the present exemplary embodiment will be described with reference to FIG. 2.

In the present exemplary embodiment, a fixing apparatus using an endless fixing belt 310 is employed. In FIG. 2, a recording material is conveyed in the direction indicated by the arrow a. The fixing apparatus 30 includes a heating rotation member 300 and a pressure rotation member 330. The heating rotation member 300 includes the fixing belt 310. The pressure rotation member 330 forms a fixing nip portion N with the fixing belt 310 by making contact with the fixing belt 310 and applying pressure thereto.

The heating rotation member 300 includes the fixing belt 310, a steering roller 350, a fixing pad 380 that is a pad member, and a heating roller 340. The steering roller 350, and the fixing pad 380 are in contact with the inner peripheral surface of the fixing belt 310. The fixing belt 310 is stretched by the steering roller 350, the fixing pad 380, and the heating roller 340.

The heating roller 340 is cylindrically formed of a metal, such as aluminum and stainless steel. In the present exemplary embodiment, the heating roller 340 is made of an aluminum pipe having an outer diameter of 80 millimeters (mm). A halogen heater 341 serving as a heating unit for heating the fixing belt 310 is disposed inside the heating roller 340. The halogen heater 341 heats the heating roller 340 to a predetermined temperature. The heating roller 340 heated by the heat from the halogen heater 341 heats the fixing belt 310. The fixing belt 310 is controlled to a predetermined target temperature corresponding to the grammage of the recording material to be fixed based on a temperature detection result of a fixing temperature detection sensor (not illustrated).

The heating unit is not limited to a halogen heater. For example, the heating unit may be configured to cause the heating roller 340 to generate heat by induction heating (IH). The heating roller 340 is driven to rotate in the direction of the arrow R1 by a drive motor M1.

The fixing belt 310 has excellent heat conductivity and heat resistance. The fixing belt 310 is shaped as a thin endless belt having an inner diameter of 120 mm, for example. In the present exemplary embodiment, the fixing belt 310 has a three-layer structure, including a base layer, an elastic layer outside the base layer, and a separating layer outside the elastic layer. The base layer is made of a polyimide resin (PI) and has a thickness of 60 micrometers (μm). The elastic layer is made of silicone rubber and has a thickness of 300 μm. The separating layer is made of a fluorocarbon resin tetrafluoroethylene perfluoroalkoxy alkanes (PFA) and has a thickness of 30 μm. The pressure rotation member 330 to be described below presses the fixing pad 380 via the fixing belt 310 and is driven to rotate, whereby the fixing belt 310 is driven to rotate. Since the heating roller 340 is driven to rotate by the drive motor M1, the fixing belt 310 can also be said to be driven to rotate by the rotational drive of the heating roller 340.

The fixing pad 380 is disposed in contact with the inner peripheral surface of the fixing belt 310 and opposed to the pressure rotation member 330 with the fixing belt 310 therebetween.

The pressure rotation member 330 includes a cylindrical aluminum core, a 1-mm-thick elastic layer outside the core, and a separating layer outside the elastic layer. The separating layer is intended to improve toner separability.

The pressure rotation member 330 is driven to rotate in the direction of the arrow R2. The fixing belt 310 sandwiched between the pressure rotation member 330 and the fixing pad 380 is thus driven to rotate by the rotational drive of the pressure rotation member 330.

The pressure rotation member 330 can be moved by a contact-separation mechanism capable of moving the pressure rotation member 330 into contact with and away from the fixing belt 310. The contact-separation mechanism includes a frame 385 and a not-illustrated drive motor. The frame 385 is supported by the main body of the image forming apparatus 100. The frame 385 supports the pressure rotation member 330. The frame 385 is driven to rotate by the not-illustrated drive motor with a rotation shaft 332 as a rotation axis. As the frame 385 is rotated clockwise in the diagram by the not-illustrated drive motor about the rotation shaft 332 as the rotation axis, the pressure rotation member 330 moves in the direction of the arrow P. The pressure rotation member 330 is thereby brought into contact (contact state) with the fixing pad 380 with the fixing belt 310 therebetween in a direction perpendicular to the conveyance direction $\alpha$ of the recording material. This forms the fixing nip portion N. In the present exemplary embodiment, the fixing belt 310 is pressed by a total pressing force of 2000 N, where the fixing nip portion N has a width of 24 mm. If the frame 385 is rotated counterclockwise in the diagram about the rotation shaft 332 as the rotation axis, the pressure rotation member 330 is separated from the fixing belt 310 (separated state).

As described above, a recording material bearing an unfixed toner image is nipped and conveyed through the fixing nip portion N by the heating rotation member 300 and the pressure rotation member 330, and the unfixed toner image is fixed to the recording material by the application of heat and pressure.

<Steering Roller>

Next, the steering roller 350 according to the present exemplary embodiment will be described with reference to FIGS. 2 and 3.

In the contact state according to the present exemplary embodiment, a force of 2000 N is applied to the fixing belt 310. The surface of the fixing belt 310 can thus be damaged by edges of recording materials and cause uneven gloss. A detailed description thereof will now be given below.

<Uneven Gloss Due to Paper Edge Scratches>

Paper edge scratches refer to scratches on the surface of the fixing belt 310 due to the contact of the cut sections (edges) of recording materials with the surface of the fixing belt. In fixing unfixed toner to a recording material, the portions of the fixing belt 310 in contact with the edges (edge contact portions) undergo higher stress than portions not in contact with the edges (edge non-contact portions). The areas damaged by the edges of recording materials can be recessed compared to the edge non-contact portions. Such recesses in the surface of the fixing belt 310 due to the edges of recording materials are referred to as paper edge scratches.

In fixing unfixed toner to a recording material, the fixing apparatus 30 applies pressure and heat to the recording material.

The surface state of the fixing belt 310 here is reflected on the gloss at the surface of the fixed image. If the surface of the fixing belt 310 is uneven, the unevenness is reflected on the gloss at the image surface. As a result, uneven gloss appears on the image surface. If unfixed toner is fixed to a recording material having paper edge scratches on the surface of the fixing belt 310, uneven gloss like straight lines appear on the image surface.

In the present exemplary embodiment, a steering control using a steering mechanism 400 for reciprocating the fixing belt 310 in its width direction is used to reduce paper edge scratches on the surface of the fixing belt 310.

The steering control will be described with reference to FIG. 3.

Figure 3:
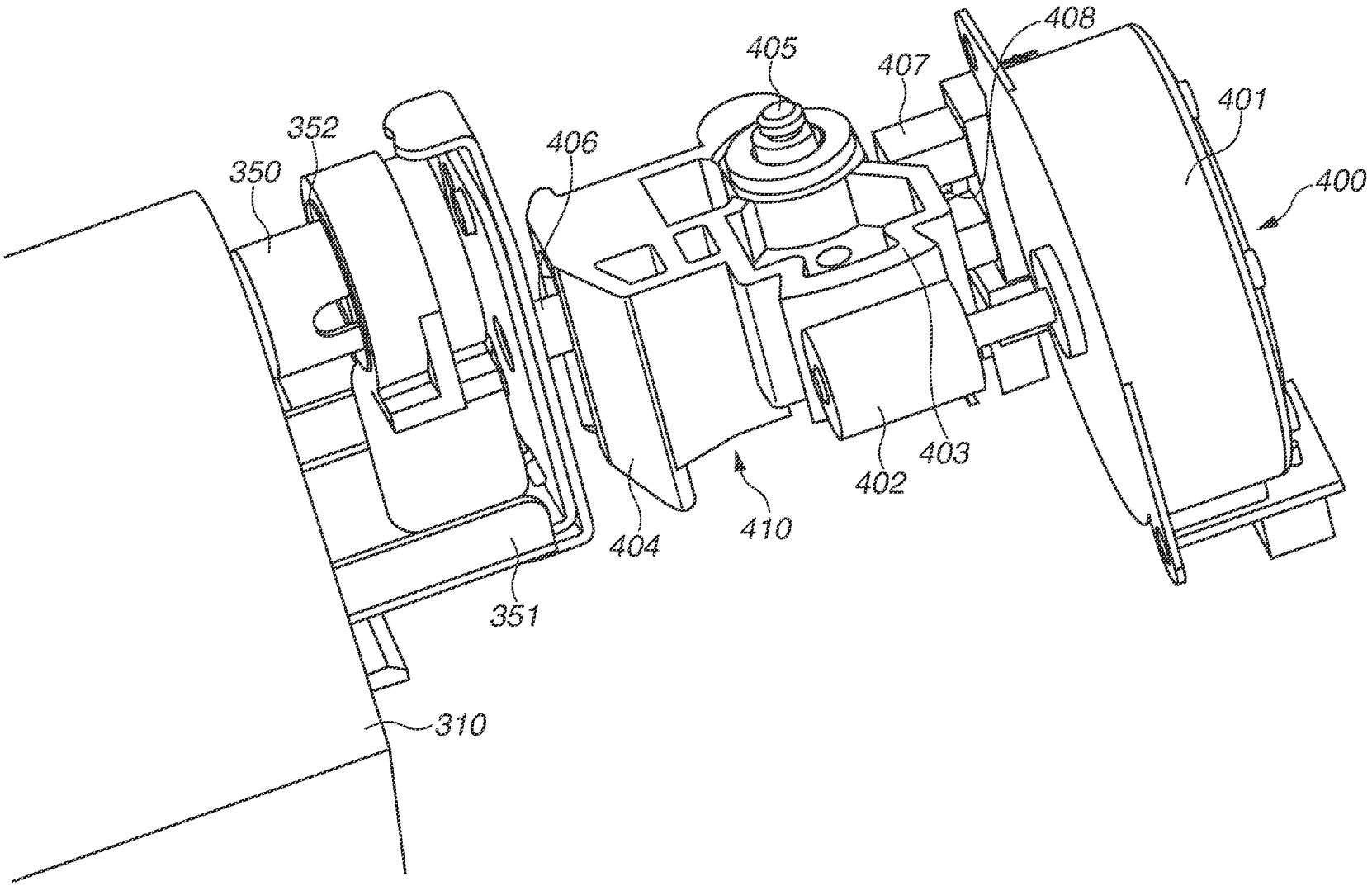
FIG. 3 is a schematic diagram illustrating a steering mechanism.

As illustrated in FIG. 3, the steering mechanism 400 includes the steering roller 350, a steering motor 401, a worm 402, a worm wheel 403, and a fork plate 404. The steering motor 401 can rotate in a forward direction and a reverse direction. As the steering motor 401 is driven to rotate by a signal from a control unit 600, the worm 402 attached to the steering motor 401 rotates.

A drive conversion unit 410 having the worm wheel 403 and the fork plate 404 integrally formed thereon converts the rotation of the worm 402 into a swing in the rotation axis direction of the steering motor 401 with a rotation shaft portion 405 as the swing center. More specifically, the worm wheel 403 is in mesh with the worm 402 and disposed to be capable of reciprocating in the rotation axis direction of the steering motor 401 based on the rotation of the worm 402. For that purpose, the worm wheel 403 is formed to have an arcuate meshing surface so that the meshing surface meshes with the worm 402 in the center in the rotation axis direction. The drive conversion unit 410 can thus be swung via the worm 402 and the worm wheel 403 with the rotation shaft portion 405 as the swing center based on the rotation of the steering motor 401.

The steering mechanism 400 also includes a steering operation shaft 406, a steering roller support arm 351, and a bearing unit 352. The steering operation shaft 406, the steering roller support arm 351, and the bearing unit 352 are integrally formed with each other and attached to the steering roller 350. The bearing unit 352 rotatably supports the rotation shaft of the steering roller 350. The steering roller support arm 351 is rotatably disposed and rotatably supports the steering roller 350 by holding the bearing unit 352.

The steering operation shaft 406 to be fitted to the foregoing drive conversion unit 410 is fixed to the steering roller support arm 351. The steering operation shaft 406 is fitted to the fork plate 404 of the drive conversion unit 410, and can move with the drive conversion unit 410 while being kept fitted to the drive conversion unit 410. The tilt of the steering roller 350 thus changes in a manner linked with the swing of the drive conversion unit 410. In other words, the angle at which the steering roller 350 is arranged with respect to the heating roller 340 (see FIG. 2) can be changed by driving the steering motor 401. If the steering angle of the steering roller 350 is thus adjusted, the fixing belt 310 stretched by the steering roller 350, the heating roller 340, and the fixing pad 380 reciprocates in the width direction. This can implement the steering control on the fixing belt 310 so that the fixing belt 310 reciprocates within a predetermined area in the width direction. The fixing belt 310 is moved to reciprocate in opposite moving directions between a case when the steering roller 350 is tilted by rotating the steering motor 401 forward and a case when the steering roller 350 is tilted by rotating the steering motor 401 backward.

As described above, the steering mechanism 400 moves the fixing belt 310 to reciprocate between predetermined positions within the area of the steering roller 350 in the width direction. The reciprocation of the fixing belt 310 prevents the edges of recording materials from passing over the same area of the surface of the fixing belt 310 repeatedly. This can reduce the occurrence of paper edge scratches on the surface of the fixing belt 310.

<Fixing Belt Position Detection>

A belt position detection unit for detecting the position of the fixing belt 310 in the width direction will be described with reference to FIGS. 2, 3, and 4.

In the present exemplary embodiment, the fixing apparatus 30 includes a sensor unit 390 for detecting the position of an end (hereinafter, may be referred to as end position) of the fixing belt 310 in the width direction. The position of the end of the fixing belt 310 is detected based on output signals of the sensor unit 390. The foregoing steering mechanism 400 is operated based on the detected end position of the fixing belt 310, whereby the tilt angle of the steering roller 350 is changed. The configuration of the sensor unit 390 will be described with reference to FIG. 4.

Figure 4:
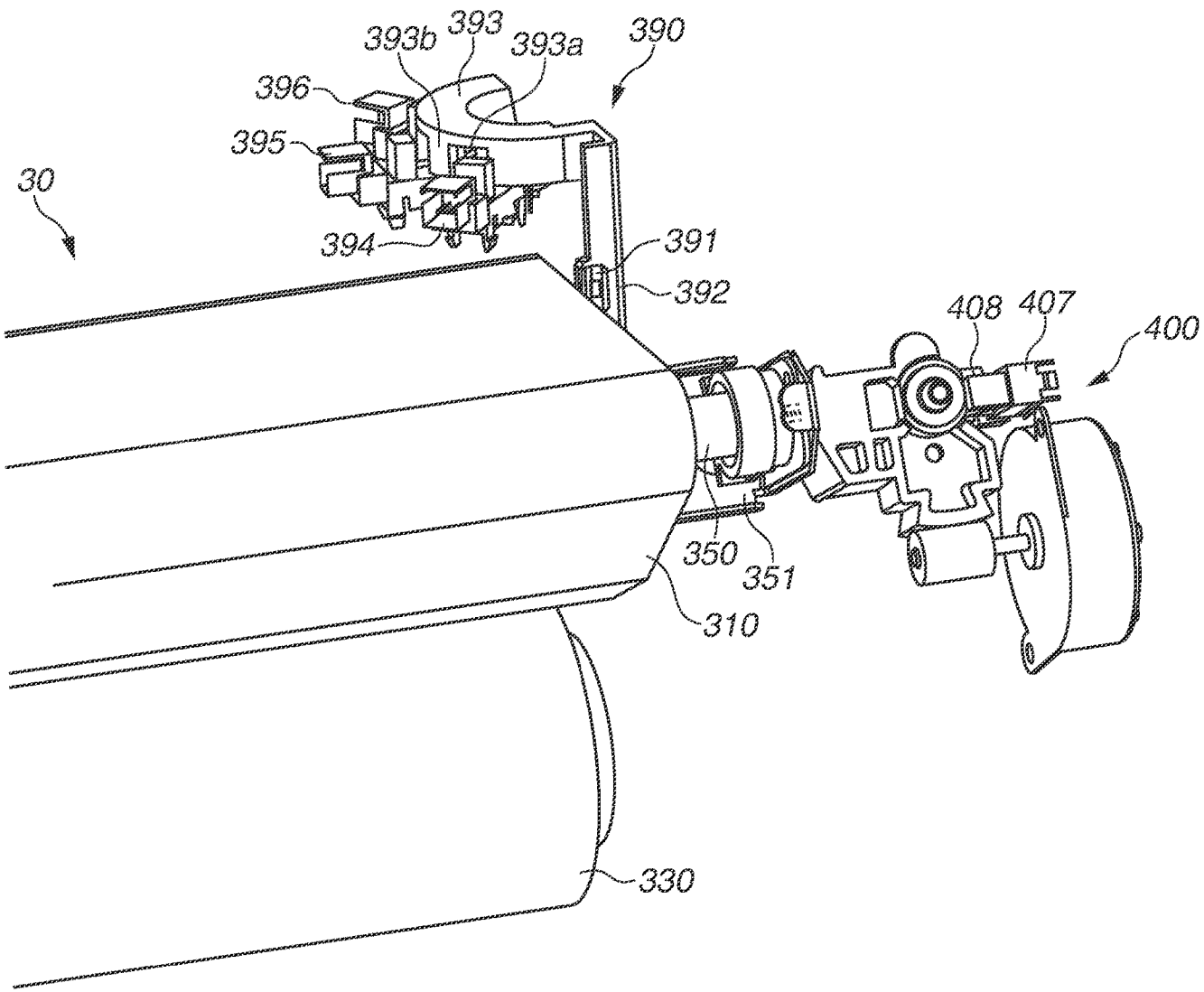
FIG. 4 is a schematic diagram illustrating a sensor unit that detects the position of a fixing belt.

As illustrated in FIG. 4, the sensor unit 390 according to the present exemplary embodiment includes a contact member 391, an arm member 392, a belt position detection unit (hereinafter, may be referred to as a sensor flag) 393, and three sensors 394, 395, and 396. The contact member 391 makes contact with the end of the fixing belt 310. The arm member 392 is intended to support the contact member 391. The belt position detection unit 393 serves as a moving member. The sensors 394, 395, and 396 are intended to detect the position of the end of the fixing belt 310. For example, optical sensors are used as the sensors 394, 395, and 396. The contact member 391 is located on one end side of the arm member 392 to make contact with the end of the fixing belt 310 in the width direction.

The arm member 392 is biased from the end of the fixing belt 310 toward the center of the same in the width direction by a coil spring (not illustrated). The arm member 392 is rotatably disposed to follow the movement of the fixing belt 310 in the width direction via the contact member 391. The belt position detection unit 393 serving as the moving member is disposed on the other end of the arm member 392. For example, the belt position detection unit 393 is a fan-shaped columnar member and has a plurality of openings 393*a* and a plurality of to-be-detected portions 393*b* in/on its arcuate outer periphery. The three sensors 394, 395, and 396 are arranged at predetermined distances along the direction of the rotational movement of the belt position detection unit 393 such that the sensors 394, 395, and 396 are opposed to the outer periphery of the belt position detection unit 393 where the openings 393*a* and the to-be-detected portions 393*b* are formed.

In the present exemplary embodiment, when the fixing belt 310 moves from one end side to the other end side in the width direction, the belt position detection unit 393 rotates with the movement of the fixing belt 310. As the belt position detection unit 393 rotates, the positional relationship between the sensors 394, 395, and 396 and the to-be-detected portions 393*b* (or openings 393*a*) changes. Specifically, a detection state where the sensors 394, 395 and 396 detect the to-be-detected portions 393*b* and a non-detection state where the sensors 394, 395, and 396 are opposed to the openings 393*a* and thus do not detect any of the to-be-detected portions 393*b* are switched.

In the present exemplary embodiment, optical sensors are used as the sensors 394, 395, and 396. The sensors 394, 395, and 396 each include a light emission unit for emitting light and a light reception unit for receiving the light emitted from the light emitting unit. The sensors 394, 395, and 396 emit a predetermined amount of light from their light emission units toward the belt position detection unit 393. If the emitted light is blocked by the to-be-detected portions 393*b* of the belt position detection unit 393, the light reception units of the sensors 394, 395, and 396 do not receive the light emitted from the light emission units. In contrast, if the emitted light is not blocked by the to-be-detected portions 393*b* but passed through the openings 393*a* of the belt position detection unit 393, the light reception units receive the light emitted from the respective light emission units. In such a manner, whether the respective sensors 394, 395, and 396 receive light depends on the movement of the belt position detection unit 393.

<Control Unit>

Figure 5:
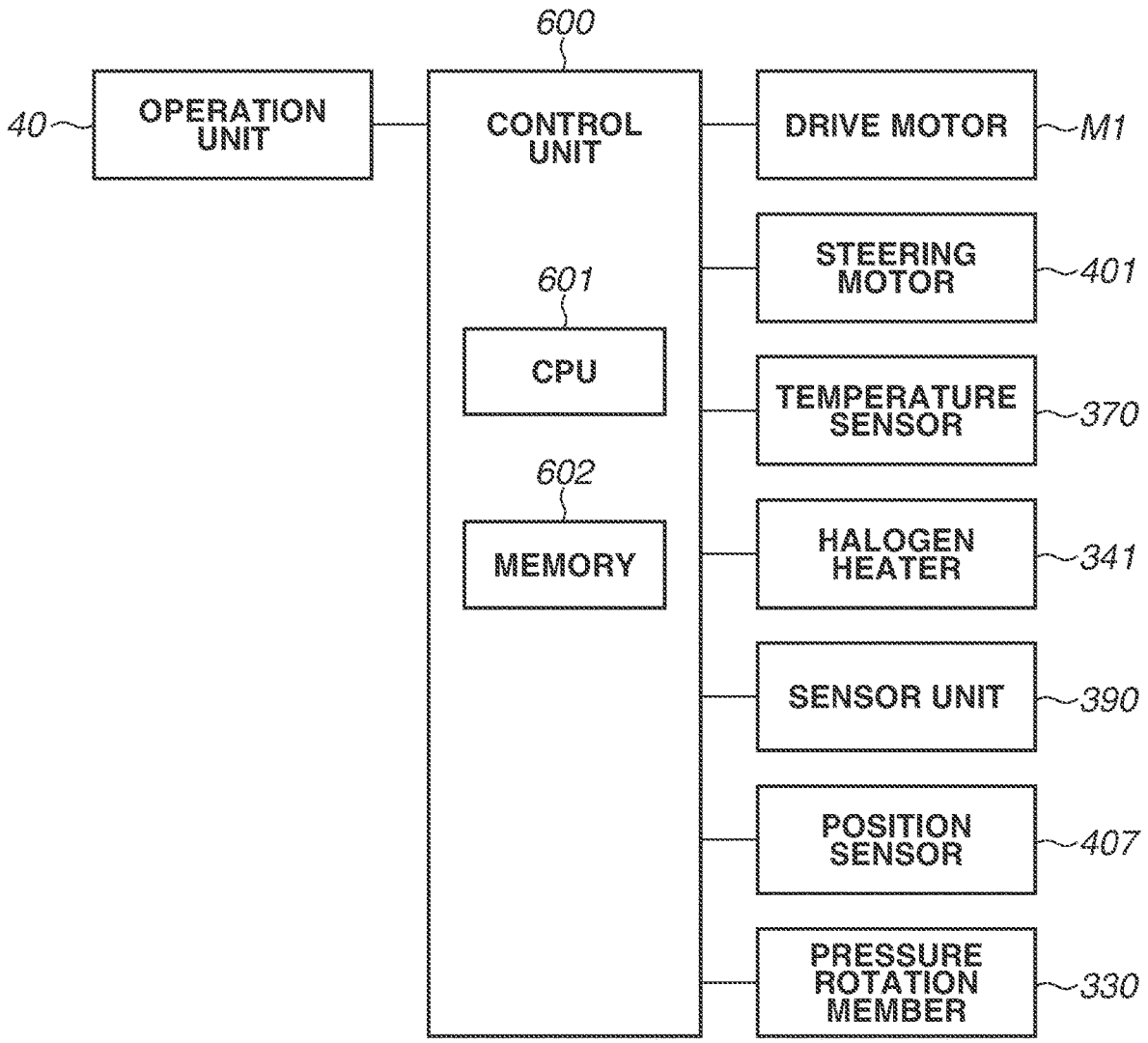
FIG. 5 is a block diagram for describing a control unit.

As illustrated in FIG. 1, the image forming apparatus 100 includes the control unit 600. The control unit 600 will be described with reference to FIG. 5 while referring to FIGS. 2 to 4. The control unit 600 is also connected with various devices other than the illustrated ones, such as motors and power supplies for operating the image forming apparatus 100. However, since such devices are irrelevant to the gist of the present exemplary embodiment, a depiction and description thereof will be omitted.

The control unit 600 serving as a control means performs various types of control such as an image forming operation. The control unit 600 includes, for example, a central processing unit (CPU) 601 and a memory 602. The memory 602 includes a read-only memory (ROM) and a random access memory (RAM). The memory 602 stores various programs and various types of data for controlling the image forming apparatus 100. The CPU 601 can execute various programs stored in the memory 602, and can operate the image forming apparatus 100 by executing the various programs.

In the present exemplary embodiment, the CPU 601 can execute, for example, an image formation job processing program and a steering control program to be described below, stored in the memory 602.

The memory 602 stores, for example, a sensor value table (see FIG. 15 to be described below) to be referred to in identifying the end position of the fixing belt 310 reciprocated by the steering control and in determining the presence or absence of a failure of the sensor unit 390 during belt deviation control processing. The memory 602 can also temporarily store, for example, the results of calculation processing associated with execution of various programs.

An operation unit 40 is connected to the control unit 600 via an input/output interface. The operation unit 40 includes, for example, a touch-panel liquid crystal screen (display unit) so that the user can input start instructions for various programs, such as the image formation job processing program, and various types of data, such as the size of a recording material (e.g., A3, B4).

The liquid crystal screen can display various screens including software keys. Various functions, such as giving start instructions for various programs assigned in advance, can be performed based on the user's touch operations on the software keys. The liquid crystal screen can also display various types of information, such as an operation status of the image forming apparatus 100 and error information, for user notification. In other words, in the present exemplary embodiment, the operation unit 40 can function as a notification unit. The method for notifying the user of various information, such as error information, is not limited to the foregoing display-based one, and any appropriate notification method may be used. Examples include a sound-based notification method using a sound producing unit, such as a speaker.

The drive motor M1, the steering motor 401, a temperature sensor 370, the halogen heater 341, the sensor unit 390, a position sensor 407, and a motor for driving the pressure rotation member 330 are further connected to the control unit 600 via input/output interfaces. If an instruction to start an image formation job is given from the operation unit 40, the control unit 600 (more specifically, CPU 601) executes the image formation job processing program stored in the memory 602. The control unit 600 controls the image forming apparatus 100 based on the execution of the image formation job processing program. The control unit 600 thus drives the drive motor M1 to rotate the heating roller 340 and thereby rotate the fixing belt 310. The control unit 600 also controls the halogen heater 341 based on the detection result of the temperature sensor 370 so that the surface temperature of the fixing belt 310 becomes a desired target temperature (in the present exemplary embodiment, 180° C.). The control unit 600 controls the motor that drives the pressure rotation member 330, and can thus determine whether the pressure rotation member 330 is in contact with or separated from the fixing belt 310.

In the present exemplary embodiment, the control unit 600 controls the steering motor 401 based on the detection result of the sensor unit 390, or more specifically, the combination of the output signals of the three sensors 394, 395, and 396 (see FIG. 6B to be described below). That is, the control unit 600 detects the end position of the fixing belt 310 based on the detection result of the sensor unit 390, and rotates the steering motor 401 forward or backward based on the amount of rotation obtained from the detected position. The control unit 600 can thus perform the steering control on the fixing belt 310 by operating the foregoing steering mechanism 400 using the steering motor 401.

<Belt Position Detection Unit>

The belt position detection unit 393 mentioned above will be described with reference to FIGS. 6A and 6B. FIG. 6A is a top view for describing the belt position detection unit 393. FIG. 6B illustrates possible combinations of the output signals of the sensors 394, 395, and 396 in using the belt position detection unit 393. FIG. 6A illustrates 27 areas configured to be used in detecting nine positions of the fixing belt 310 in the width direction using the three sensors 394, 395, and 396. For example, the sensors 394, 395, and 396 each output an output signal "0" when in the detection state where any one of to-be-detected portions 393*b*1 to 393*b*5 is detected. In other words, each sensor outputs the output signal "0" when in a blocked state where the sensor is blocked by any one of the to-be-detected portions 393*b*1 to 393*b*5. In contrast, the sensors 394, 395, and 396 each output an output signal "1" when in the non-detection state where none of the to-be-detected portions 393*b*1 to 393*b*5 is detected. In other words, each sensor outputs the output signal "1" when in an open state (also referred to as an unblocked state) where the sensor is opposed to one of openings 393*a*1 to 393*a*4.

Figures 6A, 6B:
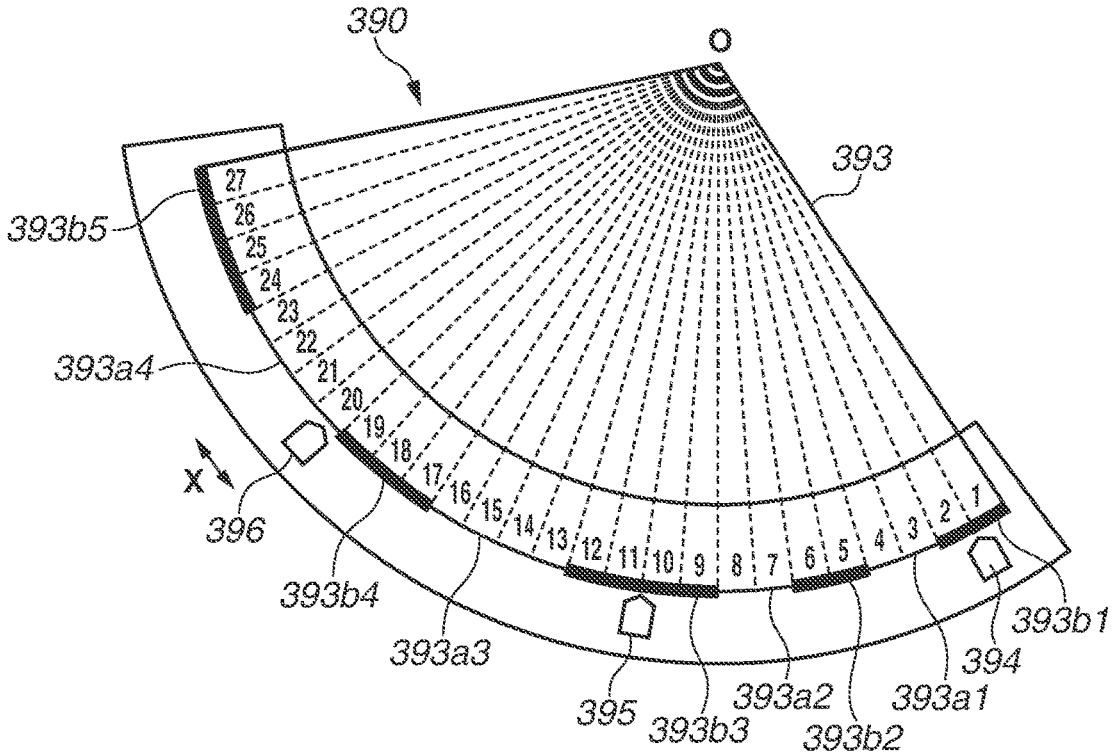
FIG. 6A is a schematic diagram illustrating a belt position detection unit for detecting the position of the fixing belt.
FIG. 6B is a table illustrating combinations of output signals.

In FIG. 6B, the sensor 394 is referred to as a "first sensor", the sensor 395 a "second sensor", and the sensor 396 a "third sensor". A belt position is a value determined by the combination of the output signals of the sensors 394, 395, and 396. In the present exemplary embodiment, the control unit 600 can detect the end position of the fixing belt 310 in steps of nine subdivided positions based on the foregoing belt position determined from the combination of the output signals ("0" or "1") of the sensors 394, 395, and 396.

Figure 7:
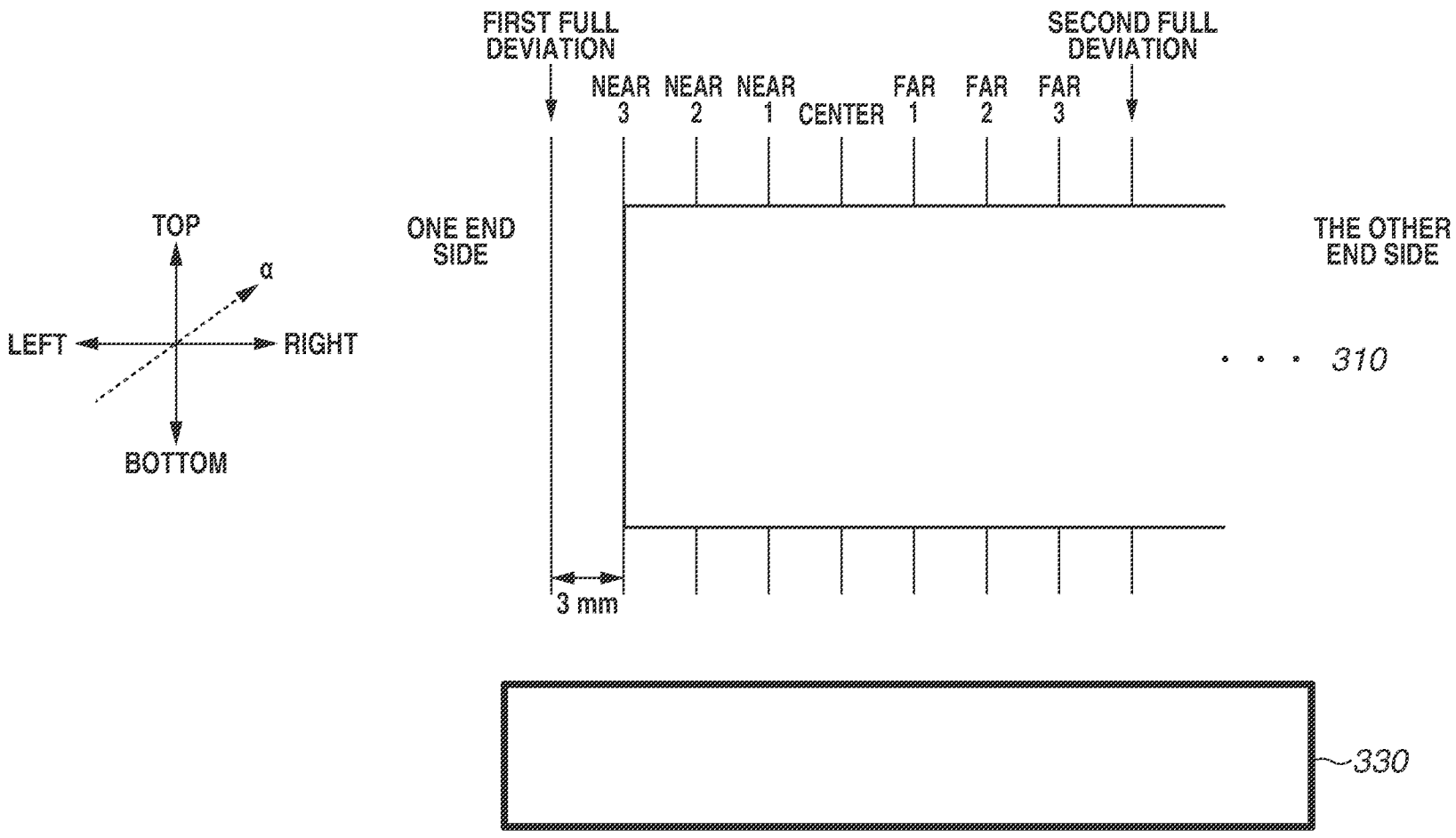
FIG. 7 is a schematic diagram illustrating the position of the fixing belt (belt position) in a width direction at one end side of the fixing belt.

The nine subdivided positions of the end position of the fixing belt 310 will be described with reference to FIG. 7. FIG. 7 is a diagram illustrating one end side of the fixing belt 310 as seen in the conveyance direction α, with the pressure rotation member 330 down. The detectable positions include a "first full deviation" position where the fixing belt 310 is fully moved to the one end side, a "second full deviation" position where the fixing belt 310 is fully moved to the other end side, and seven equally subdivided positions between the "first full deviation" position and the "second full deviation" position. The seven positions are a "near 3" position, a "near 2" position, a "near 1" position, a "center" position, a "far 1" position, a "far 2" position, and a "far 3" position in order of closeness to the "first full deviation" position. As employed herein, a "near" position refers to a position close to the side where the operation unit 40 is disposed in the image forming apparatus 100, and a "far" position refers to a position on the opposite side.

In the present exemplary embodiment, the to-be-detected portions 393*b*1 to 393*b*5 are arranged such that two or more of the sensors 394, 395, and 396 are simultaneously in the detection state "0" or the non-detection state "1" depending on the above-described position of the sensor flag 393. The to-be-detected portions 393*b*1 to 393*b*5 are also arranged such that all the sensors 394, 395, and 396 are in the detection state if the fixing belt 310 is located at the "first full deviation" position or the "second full deviation" position.

In the present exemplary embodiment, the "near 3" position will also be referred to as a first predetermined position, and the "near 1" position a second predetermined position. The "near 1" position falls on the "center" position side of the "near 3" position.

When the fixing belt 310 is located at the "center" position, it means that the center position of the fixing belt 310 in the width direction falls on the center position of the moving range of the fixing belt 310 or the center position of the steering roller 350. When the fixing belt 310 is located at the "near 1" to "near 3" positions, it means that the center position of the fixing belt 310 in the width direction falls on the one end side of the center position of the steering roller 350. By contrast, when the fixing belt 310 is located at the "far 1" to "far 3" positions, it means that the center position of the fixing belt 310 in the width direction falls on the other end side of the center position of the steering roller 350. If the sensor unit 390 detects that the fixing belt 310 is located at the second predetermined position in the width direction, it therefore means that the fixing belt 310 is located close to the center position of the steering roller 350 as compared to when the fixing belt 310 is located at the first predetermined position.

The center position of the fixing belt 310 and that of the steering roller 350 may be somewhat different because of assembly precision.

FIG. 7 illustrates the nine positions from the "first full deviation" position to the "second full deviation" position. The nine positions are arranged at equal distances. In the present exemplary embodiment, the distances are 3 mm (see FIG. 7). In the present exemplary embodiment, the "first full deviation" position is located on the one end side of the steering roller 350. The "center" position is the center one of the nine positions arranged at equal distances. If the sensor unit 390 detects that the end of the fixing belt 310 is located at the "center" position, it means that the fixing belt 310 is located at the center position of the steering roller 350 in the width direction.

As illustrated in FIG. 6A, the sensor flag 393 is a fan-shaped columnar member, and the outer periphery opposed to the sensors 394, 395, and 396 includes the five to-be-detected portions 393*b*1 to 393*b*5. In other words, the four openings 393*a*1 to 393*a*4 are formed in the outer periphery so that the five to-be-detected portions 393*b*1 to 393*b*5 are formed. In the present exemplary embodiment, the three sensors 394, 395, and 396 are arranged at predetermined distances along the moving direction of the sensor flag 393 (direction of the arrow X). The number of to-be-detected portions formed may be greater than or equal to the number of sensors, or four.

The five to-be-detected portions 393*b*1 to 393*b*5 are formed such that as the sensor flag 393 moves, one of the sensors 394, 395, and 396 is switched between the detection state and the non-detection state at a time. In other words, the to-be-detected portions 393*b*1 to 393*b*5 are formed such that only one of the output signals of the sensors 394, 395, and 396 changes at a time as the fixing belt 310 moves in the width direction, as illustrated in FIG. 6B. Suppose, for example, that the sensor flag 393 is circumferentially divided into 27 areas at equal angles about its rotation center O. The to-be-detected portions 393*b*1 to 393*b*5 are formed to have widths such as illustrated in FIG. 6A. Specifically, the to-be-detected portions 393*b*1 and 393*b*2 are formed to occupy two areas each, the to-be-detected portions 393*b*3 and 393*b*5 are formed to occupy four areas each, and the to-be-detected portion 393*b*4 is formed to occupy three areas.

As illustrated in FIG. 6B, if the sensor flag 393 illustrated in FIG. 6A is used and the fixing belt 310 (more specifically, the end position thereof) is located at the "second full deviation" position, the output signals of the three sensors 394, 395, and 396 are all "0". Specifically, the three sensors 394, 395, and 396 are in the detection state where the to-be-detected portions 393*b*1, 393*b*3, and 393*b*4 are detected, respectively. If the fixing belt 310 moves from the "second full deviation" position to the "far 3" position, the output signal of the sensor 396 changes from "0" to "1", and the output signals of the other sensors 394 and 395 remain unchanged from "0". In other words, only the output signal of the sensor 396 changes. At this time, the sensor 396 is opposed to the opening 393*a*4.

If the fixing belt 310 moves from the "far 3" position to the "far 2" position, only the output signal of the sensor 394 changes from "0" to "1". Here, the sensor 394 is opposed to the opening 393*a*1. If the fixing belt 310 moves from the "far 2" position to the "far 1" position, only the output signal of the sensor 395 changes from "0" to "1". Here, the sensor 395 is opposed to the opening 393*a*3. Specifically, all the three sensors 394, 395, and 396 are in the non-detection state, where the sensors 394, 395, and 396 are opposed to the openings 393*a*1, 393*a*3, and 393*a*4, respectively, and none of the to-be-detected portions 393*b*1 to 393*b*5 is detected. All the output signals of the three sensors 394, 395, and 396 are therefore "1".

If the fixing belt 310 moves from the "far 1" position to the "center" position, only the output signal of the sensor 394 changes from "1" to "0". Here, the sensor 394 detects the to-be-detected portion 393*b*2. If the fixing belt 310 moves from the "center" position to the "near 1" position, only the output signal of the sensor 396 changes from "1" to "0". Here, the sensor 396 detects the to-be-detected portion 393*b*5. If the fixing belt 310 moves from the "near 1" position to the "near 2" position, only the output signal of the sensor 394 changes from "0" to "1". Here, the sensor 394 is opposed to the opening 393*a*2. If the fixing belt 310 moves from the "near 2" position to the "near 3" position, only the output signal of the sensor 395 changes from "1" to "0". Here, the sensor 395 detects the to-be-detected portion 393*b*4. If the fixing belt 310 moves from the "near 3" position to the "first full deviation" position, only the output signal of the sensor 394 changes from "1" to "0". Here, the sensor 394 detects the to-be-detected portion 393*b*3. If the fixing belt 310 is located at the "first full deviation" position, the output signals of all the sensors 394, 395, and 396 are "0". That is, all the three sensors 394, 395, and 396 are in the detection state, where the to-be-detected portions 393*b*3, 393*b*4, and 393*b*5 are detected, respectively. If the fixing belt 310 moves from the "first full deviation" position to the "second full deviation" position, the output signals of the sensors 394, 395, and 396 change simply in reverse order to the foregoing. A description thereof will thus be omitted.

If the sensor unit 390 detects that the fixing belt 310 is located at the "first full deviation" position or the "second full deviation" position, the control unit 600 determines that a full deviation error has occurred. The purpose is to prevent the fixing belt 310 from running off the steering roller 350. If the control unit 600 determines that a full deviation error has occurred, the control unit 600 stops the print job and brings the pressure rotation member 330 into the separated state. Moreover, the control unit 600 may display a message that the full deviation error has occurred on the operation unit 40 to notify the user of the full deviation error. The separated state facilitates the serviceperson's recovery operation to bring the image forming apparatus 100 back into the state capable of image formation from the full deviation error. In the present exemplary embodiment, the recovery operation refers to an operation to move the fixing belt 310 toward the "center" position from the "first full deviation" position or the "second full deviation" position.

In the present exemplary embodiment, a method for detecting the position of the fixing belt 310 in the width direction using the belt position detection unit 393 and the sensors 394, 395, and 396 has been described. However, the units for detecting the position of the fixing belt 310 in the width direction are not limited thereto. A line sensor or an eddy current sensor may be used.

<Separating Pressure Roller to Prevent Temperature Increase of Non-Sheet Passing Portions>

During a print job, the pressure rotation member 330 is put in the contact state, i.e., in contact with the fixing belt 310 to perform fixing. If a recording material is conveyed to the fixing nip portion N, the heat at the surface of the pressure rotation member 330 in contact with the recording material (recording material passing area; hereinafter, referred to as a sheet passing area) is carried away by the recording material. Meanwhile, the heat at the surface of the pressure rotation member 330 not in contact with the recording material (non-recording material passing areas; hereinafter, referred to as non-sheet passing areas) is not carried away by the recording material. Thus, the non-sheet passing areas become excessively high in temperature if recording materials are continuously conveyed to the fixing nip portion N. This causes a significant thermal expansion of the non-sheet passing areas of the pressure rotation member 330, producing a difference in the conveyance speed between the sheet passing area and the non-sheet passing areas. The greater the difference in the conveyance speed, the more likely the recording materials are to get creased. In particular, the ranges of the non-sheet passing areas increase, and thus recording materials of smaller sizes are more likely to get creased.

To prevent an excessive temperature increase of the non-sheet passing areas, the contact-separation mechanism brings the pressure rotation member 330 into the separated state between sheets. Suppose, for example, there is a sheet interval where no recording material is conveyed to the fixing nip portion N (non-sheet passing state) due to post-processing such as a stapling operation. In such a case, the contact-separation mechanism brings the pressure rotation member 330 into the separated state. The separation of the pressure rotation member 330 from the fixing belt 310 can prevent the heat of the fixing belt 310 from conducting to the pressure rotation member 330 and causing a temperature increase.

<Steering Control in First Mode>

Details of a first mode of steering control applied when the pressure rotation member 330 is in the contact state will now be described.

When the fixing apparatus 30 performs fixing by applying heat and pressure to a recording material bearing an unfixed toner image, the pressure rotation member 330 enters the contact state where the pressure rotation member 330 makes contact with the fixing belt 310 to form the nip portion N. In the contact state, the edges of the recording material can produce edge scratches on the surface of the fixing belt 310 as described in the <Uneven Gloss Due to Paper Edge Scratches> section. To reduce deterioration to the surface of the fixing belt 310 due to paper edge scratches, the control unit 600 therefore performs a steering control to reciprocate the fixing belt 310 in the width direction.

Figure 8:
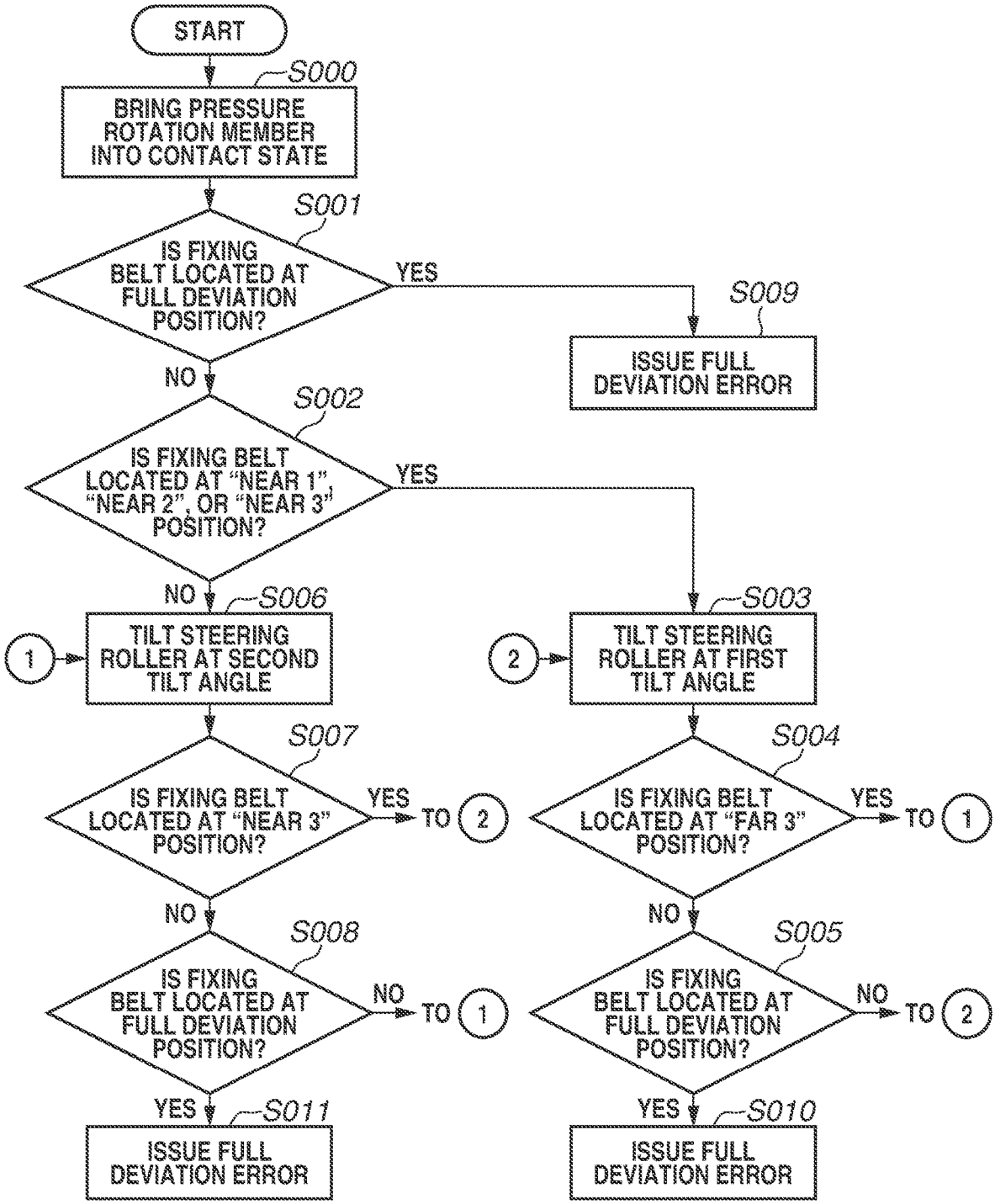
FIG. 8 is a flowchart illustrating a steering control in a first mode.

Details of the steering control by the control unit 600 will be described with reference to FIGS. 8, 9, and 10. A description will initially be given with reference to the flowchart of FIG. 8.

In step S000, the contact-separation mechanism brings the pressure rotation member 330 into the contact state.

In step S001, the sensor unit 390 detects the position of the fixing belt 310 for the first time. If the sensor unit 390 detects that the fixing belt 310 is located at the "first full deviation" position or the "second full deviation" position (full deviation position) (YES in step S001), the processing proceeds to step S009. In step S009, the control unit 600 issues a full deviation error.

If the fixing belt 310 is not detected to be located at either full deviation position (NO in step S001), the processing proceeds to step S002.

In step S002, if the sensor unit 390 detects by the first detection that the fixing belt 310 is located at the "near 1", "near 2", or "near 3" position (YES in step S002), the processing proceeds to step S003. If the sensor unit 390 detects by the first detection that the fixing belt 310 is located at the "center", "far 1", "far 2", or "far 3" position (NO in step S002), the processing proceeds to step S006.

In step S003, the control unit 600 performs an operation to tilt the steering roller 350 to a first tilt angle.

The first tilt angle will be described with reference to FIG. 9. FIG. 9 is a view in the direction of the arrow a illustrated in FIG. 2. Since FIG. 9 is intended to describe the tilt angle of the steering roller 350, the fixing belt 310 is not illustrated. The pressure rotation member 330 is illustrated to the bottom. In FIG. 9, a steering roller 350*a* represents the steering roller 350 is situated in parallel with the heating roller 340. The first tilt angle refers to the angle at which the steering roller 350 is tilted with respect to the steering roller 350*a* to move the fixing belt 310 toward the other end of the steering roller 350. In the present exemplary embodiment, the control unit 600 performs an operation to tilt the steering roller 350*a* up to the position of a steering roller 350*b* counterclockwise in FIG. 9. The direction in which the steering roller 350*a* is tilted counterclockwise in FIG. 9 will be referred to as a first direction. Such an operation tends to move the fixing belt 310 toward the other end of the steering roller 350. The tilt angle from the steering roller 350*a* to the steering roller 350*b* is referred to as the first tilt angle (angle A). In the present exemplary embodiment, the steering roller 350*a* is described to be parallel to the heating roller 340. However, the angle of the steering roller 350*a* may be somewhat different due to variations in assembly precision.

As a result of the operation to tilt the steering roller 350*a* to the position of the steering roller 350*b*, the steering roller 350 is tilted at the first tilt angle.

It takes approximately 1.5 seconds to change the tilt angle of the steering roller 350. There is therefore a possibility that the fixing belt 310 moves beyond the "near 3" position toward the "first full deviation" position (overshoot). If the fixing belt 310 reaches the "first full deviation" position and the sensor unit 390 detects that the fixing belt 310 is located at the "first full deviation" position, the control unit 600 issues a full deviation error.

The fixing belt 310 can sometimes move beyond the "near 3" position toward the "first full deviation" position and not reach the "first full deviation" position. In such a case, the steering roller 350 is tilted at the first tilt angle, and thereby the fixing belt 310 is moved from between the "near 3" position and the "first full deviation" position toward the other end of the steering roller 350. The sensor unit 390 thereby detects that the fixing belt 310 is located at the "near 3" position, while the steering roller 350 is tilted in the first direction at the first tilt angle (angle A).

Since the steering roller 350 is tilted at the first tilt angle, the fixing belt 310 moves to the "near 2", "near 1" (second predetermined position), "center", "far 1", and "far 2" positions in order. As the fixing belt 310 moves toward the other end, the sensor unit 390 detects the position of the fixing belt 310 at the "near 2", "near 1" (second predetermined position), "center", "far 1", and "far 2" positions. In the meantime, the control unit 600 does not perform the operation to change the tilt angle of the steering roller 350 by the steering control, and the steering roller 350 remains tilted at the first tilt angle. Alternatively, the sensor unit 390 may be configured to not detect that the fixing belt 310 is located at the "near 2", "near 1" (second predetermined position), "center", "far 1", or "far 2" position so that the operation to change the tilt angle of the steering roller 350 by the steering control will not be performed.

In step S004, if the fixing belt 310 is moved toward the other end of the steering roller 350 and the sensor unit 390 detects that the fixing belt 310 is located at the "far 3" position (YES in step S004), the processing proceeds to step S006. If the sensor unit 390 does not detect that the fixing belt 310 is located at the "far 3" position (NO in step S004), the processing proceeds to step S005.

In step S005, if the fixing belt 310 is detected to be located at the full deviation position ("second full deviation" position) (YES in step S005), the processing proceeds to step S010. In step S010, the control unit 600 issues a full deviation error. If the fixing belt 310 is not detected to be located at the full deviation position (NO in step S005), the processing returns to step S003.

In step S006, the control unit 600 performs an operation to tilt the steering roller 350 at angle −A to move the fixing belt 310 toward the one end.

Figure 9:
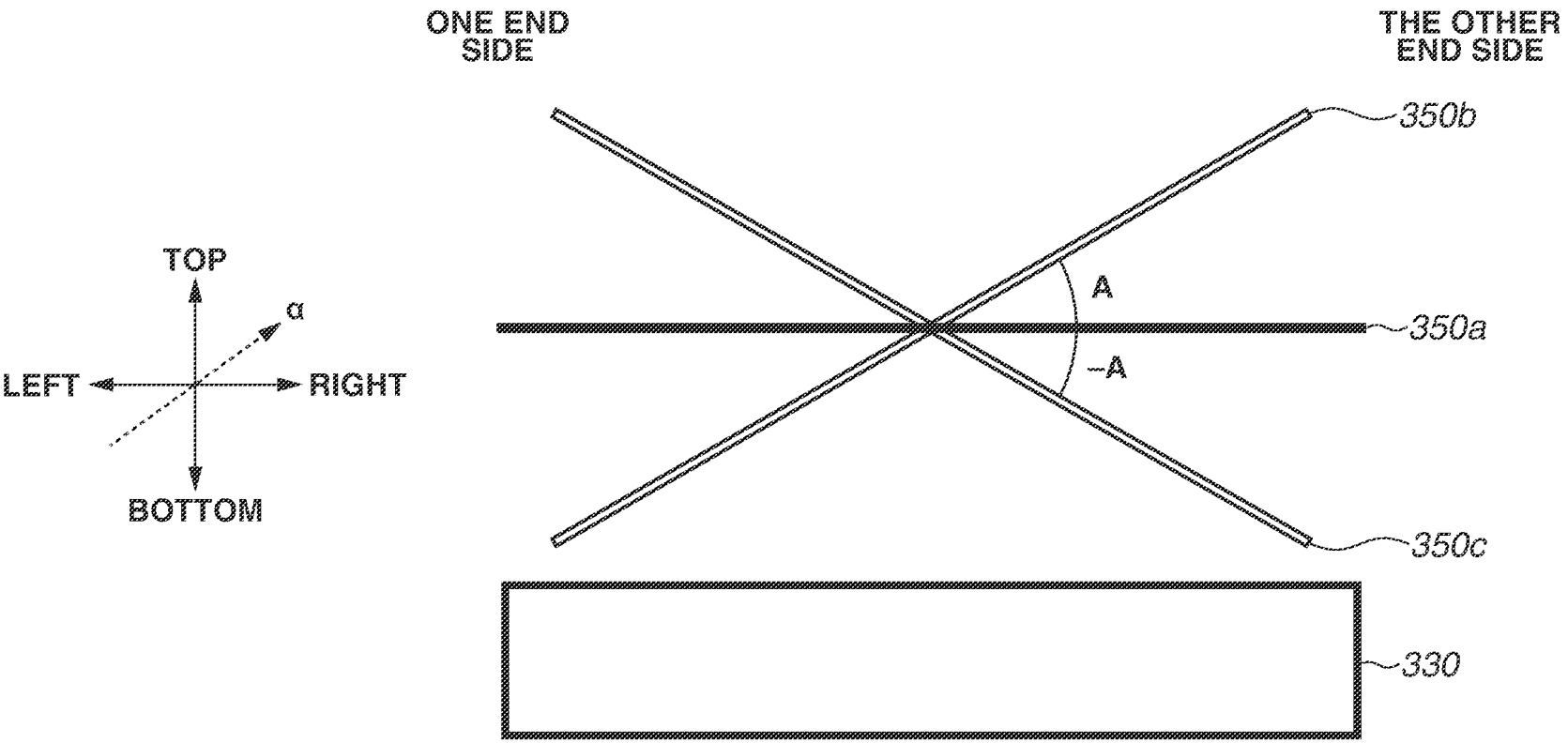
FIG. 9 is diagram illustrating tilt angles (A and −A) of a steering roller.

The steering roller 350*a* in FIG. 9 represents the steering roller 350 situated in parallel with the heating roller 340. Angle −A refers to the angle at which the steering roller 350 is tilted with respect to the steering roller 350*a* to move the fixing belt 310 toward the one end of the steering roller 350. In the present exemplary embodiment, the control unit 600 performs an operation to tilt the steering roller 350*a* to the position of a steering roller 350*c* clockwise in FIG. 9. The direction in which the steering roller 350*a* is tilted clockwise in FIG. 9 will be referred to as a second direction. In other words, the second direction is the direction where the steering roller 350 is tilted clockwise reverse to the first direction where the steering roller 350 is tilted counterclockwise in FIG. 9. Such an operation tends to move the fixing belt 310 toward the one end of the steering roller 350. The tilt angle from the steering roller 350*a* to the steering roller 350*c* here is referred to as angle −A.

As a result of the operation to tilt the steering roller 350*a* to the position of the steering roller 350*c*, the steering roller 350 is tilted at angle −A.

It takes approximately 1.5 seconds to change the tilt angle of the steering roller 350. There is therefore a possibility that the fixing belt 310 moves beyond the "far 3" position toward the "second full deviation" position (overshoot). If the fixing belt 310 reaches the "second full deviation" position and the sensor unit 390 detects that the fixing belt 310 is located at the "second full deviation" position, the control unit 600 issues a full deviation error.

The fixing belt 310 can sometimes move beyond the "far 3" position toward the "second full deviation" position and not reach the "second full deviation" position. In such a case, the steering roller 350 is tilted at angle −A, and thereby the fixing belt 310 is moved from between the "far 3" position and the "second full deviation" position toward the one end of the steering roller 350. Here, the sensor unit 390 detects that the fixing belt 310 is located at the "far 3" position, while the steering roller 350 is tilted at angle −A.

Since the steering roller 350 is tilted at angle −A, the fixing belt 310 moves to the "far 2", "far 1", "center", "near 1" (second predetermined position), and "near 2" positions in order. As the fixing belt 310 moves toward the one end, the sensor unit 390 detects the position of the fixing belt 310 at the "far 2", "far 1", "center", "near 1" (second predetermined position), and "near 2" positions. In the meantime, the control unit 600 does not perform the operation to change the tilt angle of the steering roller 350 by the steering control, and the steering roller 350 remains tilted at angle −A.

Alternatively, the sensor unit 390 may be configured to not detect that the fixing belt 310 is located at the "far 2", "far 1", "center", "near 1", or "near 2" position so that the control unit 600 will not perform the operation to change the tilt angle of the steering roller 350.

In step S007, if the fixing belt 310 is moved toward the one end of the steering roller 350 and the sensor unit 390 detects that the fixing belt 310 is located at the "near 3" position (first predetermined position) (YES in step S007), the processing proceeds to step S003. If the sensor unit 390 does not detect that the fixing belt 310 is located at the "near 3" position (NO in step S007), the processing proceeds to step S008.

In step S008, if the fixing belt 310 is detected to be located at the full deviation position ("first full deviation" position) (YES in step S008), the processing proceeds to step S011. In step S011, the control unit 600 issues a full deviation error. If the fixing belt 310 is not detected to be located at the full deviation position (NO in step S008), the processing returns to step S006.

If the sensor unit 390 detects that the fixing belt 310 is at the "near 1", "near 2", "far 1", or "far 2" position, the control unit 600 does not perform the operation to change the tilt angle of the steering roller 350. Instead, the control unit 600 performs the operation to change the tilt angle of the steering roller 350 at the "near 3" and "far 3" positions. The fixing belt 310 is thus reciprocated between the "near 3" position (first predetermined position) and the "far 3" position. In other words, the fixing belt 310 can be reciprocated over a wide range in the width direction without causing a full deviation error. The reciprocation of the fixing belt 310 over a wide range in the width direction increases the range of the fixing belt 310 where the edges of recording materials can pass. This can reduce repetitive passing of the edges of recording material over the same area of the fixing belt 310. Deterioration to the surface of the fixing belt 310 due to paper edge scratches can thus be reduced.

As illustrated in FIG. 9, the steering roller 350 is tilted at angle A or −A in the first mode. Angles A and −A are greater than angles B, −B, C, and −C illustrated in FIGS. 13 and 14 to be described below. The large tilt angles of the steering roller 350 can increase the moving speed of the fixing belt 310 in the width direction. The increased moving speed of the fixing belt tends to reduce repetitive passing of the edges of recording materials over the same area of the fixing belt 310. Deterioration to the surface of the fixing belt 310 due to edge scratches can thus be reduced.

While the steering control is described to be performed at the "near 3" and "far 3" positions, the steering control may also be performed at the "near 2" and "far 2" positions. In such a case, if the sensor unit 390 detects that the fixing belt 310 is located at the "near 2" position, the operation to tilt the steering roller 350 is performed. Here, the steering roller 350 is tilted closer to the steering roller 350*a* than is the steering roller 350*b*. Similarly, if the sensor unit 390 detects that the fixing belt 310 is located at the "far 2" position, the operation to tilt the steering roller 350 is performed. Here, the steering roller 350 is tilted closer to the steering roller 350*a* than is the steering roller 350*c*.

First Exemplary Embodiment

<Steering Control in Second Mode>

Brining the pressure rotation member 330 in the non-sheet passing state from the contact state into the separated state prevents an increase in the surface temperature of the pressure rotation member 330 and avoids the occurrence of creases in the recording materials.

For the sake of fixing, the pressure rotation member 330 applies a pressure of approximately 2000 N to the fixing pad 380 via the fixing belt 310. If the pressure rotation member 330 transitions from the contact state to the separated state, the fixing belt 310 is released from the pressure of approximately 2000 N. This increases the reciprocation speed of the fixing belt 310 in the width direction by the steering control. The reciprocation speed of the fixing belt 310 in the width direction when the pressure rotation member 330 is in the separated state is approximately three times as compared to when the pressure rotation member 330 is in the contact state.

The full deviation error to occur at the timing when the pressure rotation member 330 enters the separated state will be described with reference to FIG. 10. FIG. 10 illustrates an example where the control unit 600 performs an operation to change the tilt angle of the steering roller 350 if the fixing belt 310 is located at the "near 2" or "far 2" position. At time (a) in FIG. 10, the pressure rotation member 330 transitions from the contact state to the separated state while the fixing belt 310 is being moved toward the other end of the steering roller 350. Conventionally, there has been a concern that the moving speed of the fixing belt 310 in the width direction increases abruptly at time (b) in FIG. 10 and the fixing belt 310 reaches the full deviation position at time (c) in FIG. 10, causing a full deviation error. The present exemplary embodiment is then intended to reduce the possibility for a full deviation error to occur at the timing when the pressure rotation member 330 transitions from the contact state to the separated state between sheets.

A detailed method for controlling the steering roller 350 will now be described.

If the recording material conveyed to the fixing nip portion N is the last one before the separated state, the control unit 600 performs a steering control to move the fixing belt 310 to the "center" position. The steering control to be performed when the last recording material before the separated state is conveyed to the fixing nip portion N will be referred to as a second mode.

Figure 11:
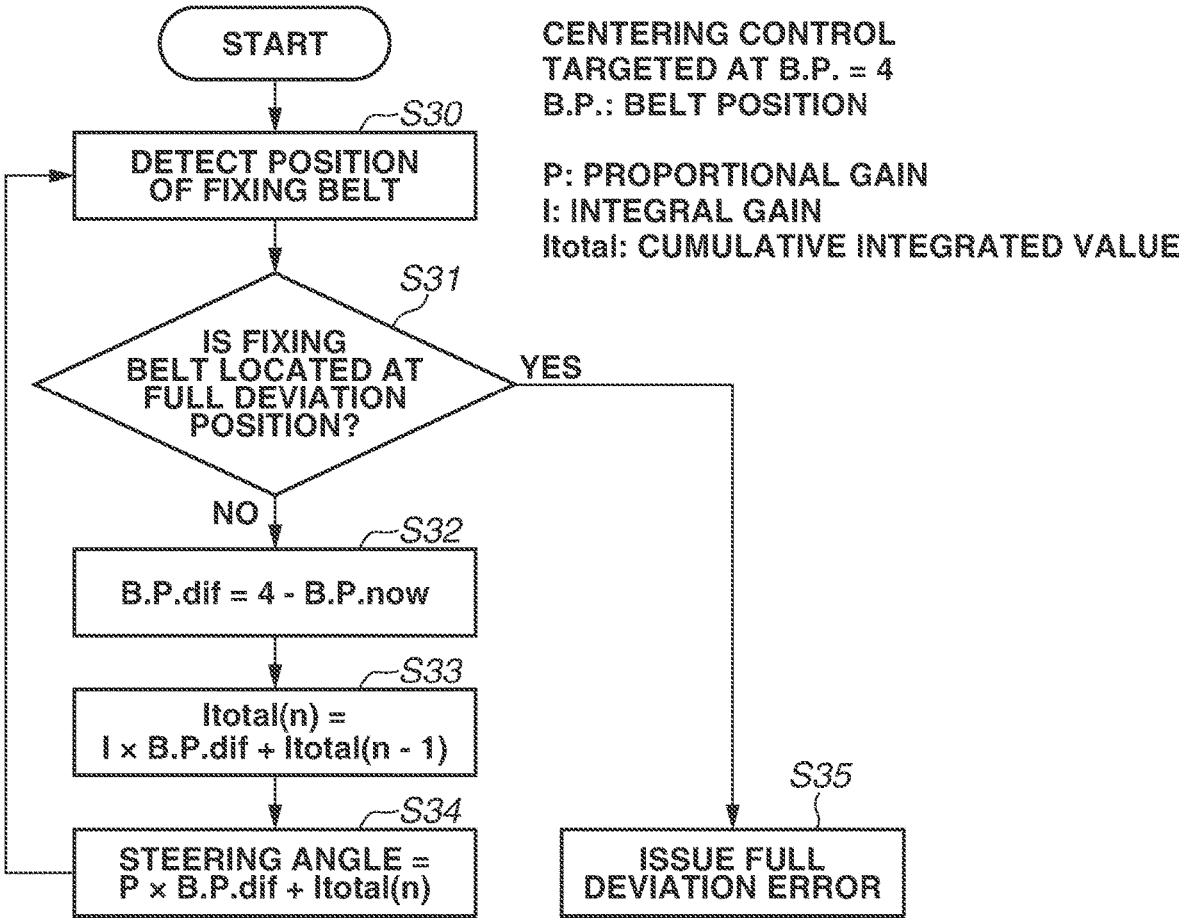
FIG. 11 is a flowchart illustrating a steering control in a second mode.

In the second mode, a target position of the fixing belt 310 is set (in the present exemplary embodiment, the target position is the "center" position) and the operation to tilt the steering roller 350 is performed to move the fixing belt 310 to the target position. A specific method for determining the tilt angle will be described with reference to the flowchart of FIG. 11.

The control unit 600 determines whether the recording material conveyed to the fixing nip portion N is the last one before the separated state. If the recording material is the last one before the separated state, the control unit 600 performs the second mode of steering control. In contrast, in performing fixing on recording materials preceding the last one before the separated state, the fixing belt 310 can be reciprocated over a wide range in the width direction to reduce deterioration to the fixing belt 310 due to edge scratches.

If the control unit 600 determines that the recording material conveyed to the fixing nip portion N is the last one before the separated state, then in step S30, the sensor unit 390 initially detects the position of the fixing belt 310.

In step S31, if the fixing belt 310 is located at a full deviation position (YES in step S31), the processing proceeds to step S35. In step S35, the control unit 600 issues a full deviation error.

If the fixing belt 310 is not located at a full deviation position (NO in step S31), the processing proceeds to step S32.

In step S32, the control unit 600 determines a difference B.P.dif from the "center" position that is the target position based on the detection result (B.P.now) of the sensor unit 390:

$$B.P.\text{dif}=4-B.P.\text{now}. \qquad \text{Eq. 1}$$

Possible numerical values of B.P.now are 1 to 7. FIG. 15 illustrates the relationship between the position of the fixing belt 310 and the numerical value to be substituted into B.P.now. For example, if the fixing belt 310 is at the "near 3" position (first predetermined position), the control unit 600 substitutes 1 into B.P.now. If the fixing belt 310 is at the "far 3" position, the control unit 600 substitutes 7 into B.P.now.

In step S33, the control unit 600 adds the product of the difference B.P.dif and an integral gain I to the previous cumulative integrated value Itotal:

$$I\text{total}(n)=I\times B.P.\text{dif}+I\text{total}(n-1). \qquad \text{Eq. 2}$$

Here, the initial value of Itotal is 0.

In step S34, the control unit 600 determines the sum of the product of the difference B.P.dif and a proportional gain P and the cumulative integrated value Itotal(n) as a steering angle:

$$\text{Steering angle}=P\times B.P.\text{dif}+I\text{total}(n). \qquad \text{Eq. 3}$$

In the present exemplary embodiment, the proportional gain P is 100, the integral gain I is 1, and the calculation is performed at every 0.2 seconds. For example, if the detection result of the sensor unit 390 is the "far 1" position, the control unit 600 substitutes 5 into B.P.now. In such a case, the steering angle is given by the following equation:

$$\text{Steering angle}=100\times(4-5)+1\times(4-5)+I\text{total}(n-1)=-101+I\text{total}(n-1).$$

The tilt angle of the steering roller 350 is determined from the value of the steering angle determined by the foregoing calculation.

The tilt angle can be positive or negative with respect to the steering roller 350*a*. If the value determined by Eqs. 1 to 3 is positive, the operation to tilt the steering roller 350 is performed to move the fixing belt 310 toward the other end of the steering roller 350. If the steering angle is positive, the steering roller 350 is tilted counterclockwise in FIGS. 9, 13, and 14 (first direction). Similarly, if the value of the steering angle is negative, the operation to tilt the steering roller 350 is performed to move the fixing belt 310 toward the one end of the steering roller 350. If the steering angle is negative, the steering roller 350 is tilted clockwise in FIGS. 9, 13, and 14 (second direction).

In the present exemplary embodiment, the first mode of steering control does not include an operation to tilt the steering roller 350 when the fixing belt 310 is located at the "near 1" position (second predetermined position). The second mode of steering control includes the operation to tilt the steering roller 350 at angle B when the fixing belt 310 is located at the "near 1" position (second predetermined position).

Figure 13:
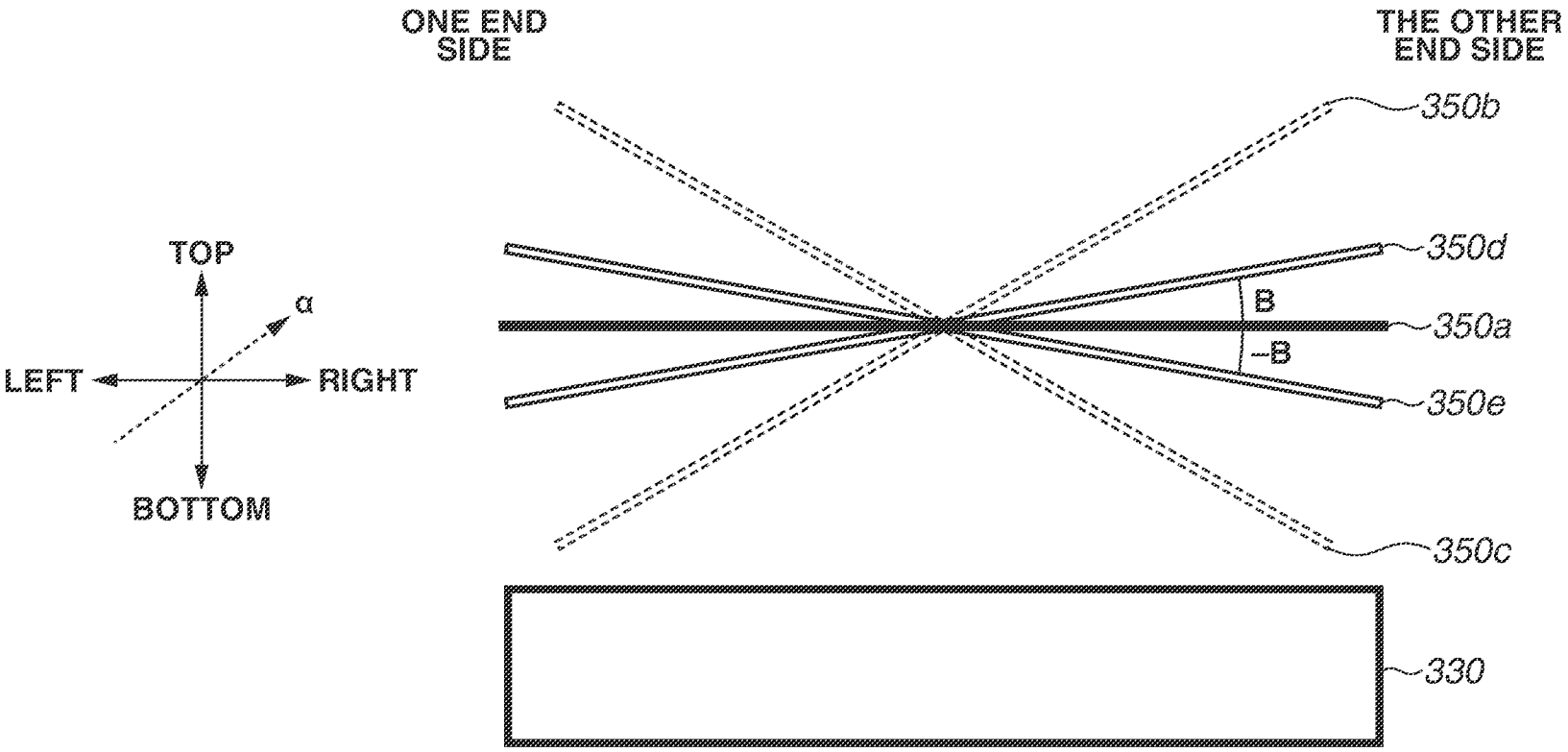
FIG. 13 is a diagram illustrating tilt angles (B and −B) of the steering roller.

Angle B will be described. In FIG. 13, angle B is an angle at which the steering roller 350 is tilted with respect to the steering roller 350*a* to move the fixing belt 310 toward the other end of the steering roller 350. If the steering roller 350 is tilted in the first direction, i.e., counterclockwise in the diagram, the fixing belt 310 tends to move toward the other end of the steering roller 350. If the sensor unit 390 detects that the fixing belt 310 is located at the "near 1" position (second predetermined position), the control unit 600 tilts the steering roller 350 to the position of a steering roller 350*d* that is a position on the steering roller 350*a* side of the steering roller 350*b*. The tilt angle here is referred to as angle B. In other words, the first tilt angle (angle A)>angle B.

Similarly, if the sensor unit 390 detects that the fixing belt 310 is located at the "far 1" position, the control unit 600 tilts the steering roller 350 in the second direction, i.e., clockwise in the diagram. Here, the steering roller 350 is tilted to the position of a steering roller 350*e* (angle −B) that is a position on the steering roller 350*a* side as compared to the case where the steering roller 350 is tilted at angle −A.

In the second mode, if the fixing belt 310 is located at the "near 2" position, the control unit 600 performs an operation to tilt the steering roller 350 at angle C.

Figure 14:
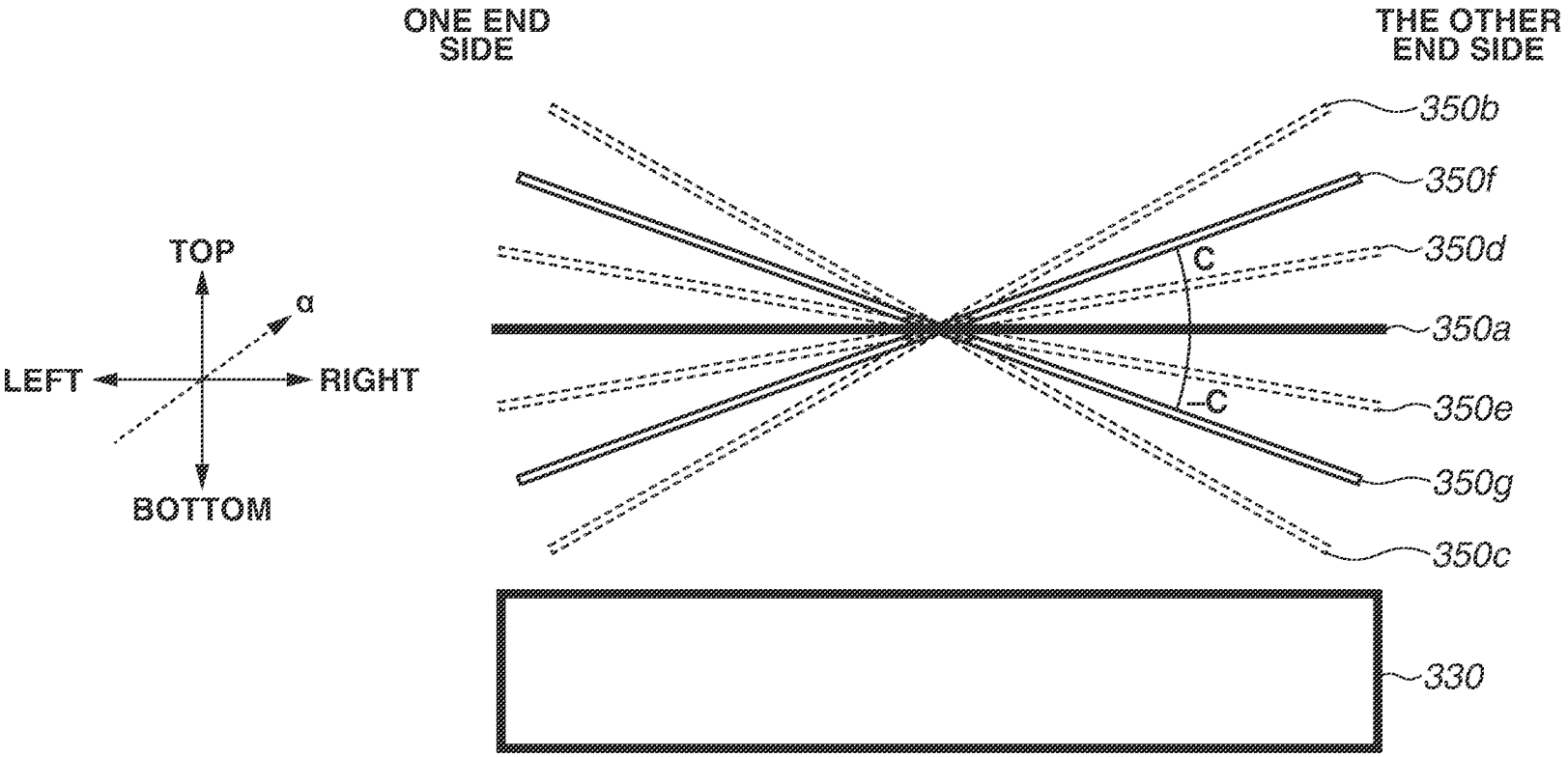
FIG. 14 is a diagram illustrating tilt angles (C and −C) of the steering roller.

In FIG. 14, angle C is an angle at which the steering roller 350 is tilted from the steering roller 350*a* to move the fixing belt 310 toward the other end of the steering roller 350. If the steering roller 350 is tilted counterclockwise in the diagram, the fixing belt 310 tends to move toward the other end of the steering roller 350. If the sensor unit 390 detects that the fixing belt 310 is located at the "near 2" position, the control unit 600 tilts the steering roller 350 to the position of a steering roller 350*f* that is a position on the steering roller 350*b* side as compared to the case where the steering roller 350 is tilted at angle B. The tilt angle here is referred to as angle C. In other words, the firth tilt angle (angle A)>angle C>angle B.

Similarly, if the sensor unit 390 detects that the fixing belt 310 is located at the "far 2" position, the control unit 600 tilts the steering roller 350 in the second direction, i.e., clockwise in the diagram. Here, the steering roller 350 is tilted to the position of a steering roller 350*g* (angle −C) that is a position on the steering roller 350*c* side as compared to the case where the steering roller 350 is tilted at angle −B.

From Eqs. 1, 2, and 3, if the fixing belt 310 is located at the "center" position that is the target position, the steering angle according to the present exemplary embodiment is 0. Here, the steering roller 350 is tilted to maintain the fixing belt 310 at the "center" position. If the fixing belt 310 is located at the "center" position that is the target position, the fixing belt 310 is thereby prevented from moving toward the other end or the one end of the steering roller 350. In FIGS. 9, 13, and 14, the steering angle of 0 indicates that the steering roller 350 is situated as the steering roller 350*a*, and that the steering roller 350*a* is parallel to the heating roller 340. However, the steering roller 350 at the steering angle of 0 can be nonparallel to the heating roller 340 because of variations in the assembly precision. The zero steering angle of the steering roller 350 may thus be somewhat different from the state of being parallel to the heating roller 340.

The greater the absolute value of the determined steering angle, the greater the amount of clockwise or counterclockwise movement from the steering roller 350*a* illustrated in FIGS. 9, 13, and 14. In other words, the farther the position of the fixing belt 310 is from the "center" position that is the target position, the greater the tilt angle of the steering roller 350.

Figure 12:
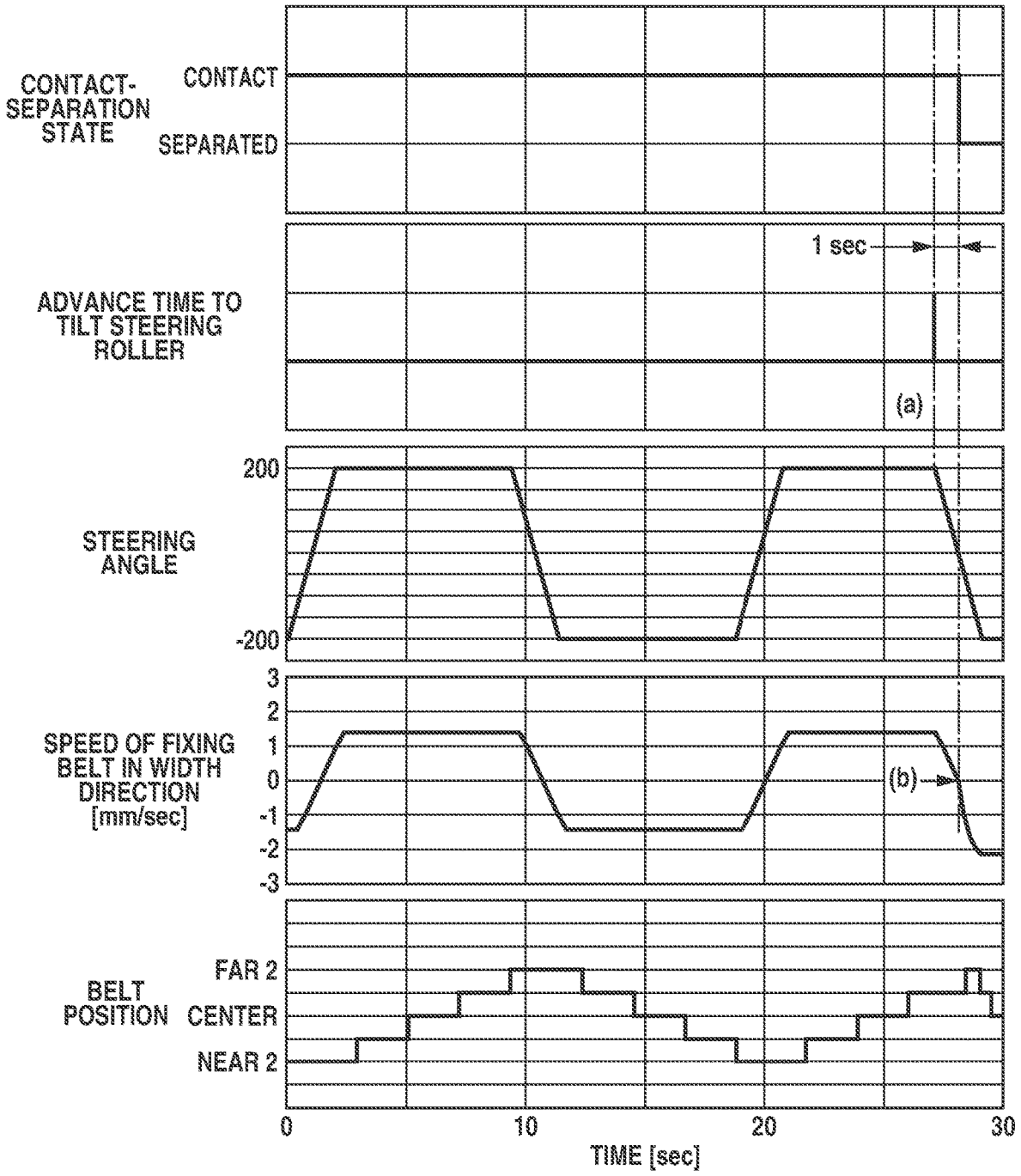
FIG. 12 is a diagram illustrating a relationship between the belt position, the moving speed of the fixing belt in the width direction, and the tilt angle of the steering roller according to a first exemplary embodiment.

The relationship between the steering control in the second mode and the moving speed of the fixing belt 310 in the width direction will be described with reference to FIG. 12. At time (a) in FIG. 12, the control unit 600 performs the second mode of steering control. Time (a) in FIG. 12 represents a time when the last recording material before the separated state is conveyed to the fixing nip portion N. The control unit 600 changes the tilt angle of the steering roller 350 to move the fixing belt 310 to the "center" position. The fixing belt 310 can thereby be prevented from moving to the full deviation position when the pressure rotation member 330 transitions from the contact state to the separated state (time (b) in FIG. 12). This can prevent the occurrence of a full deviation error when the pressure rotation member 330 transitions from the contact state to the separated state.

A case where the fixing belt 310 is located at the "near 1" to "near 3" positions when the last recording material before the separated state is conveyed to the fixing nip portion N will be described. If the fixing belt 310 is located at the "near 1" to "near 3" positions, B.P.now is any one of 1, 2, and 3. This indicates that the center position of the fixing belt 310 in the width direction falls on the one end side of the steering roller 350 with respect to the center position of the steering roller 350. If the fixing belt 310 is located at any one of the "near 1" to "near 3" positions, the control unit 600 tilts the steering roller 350 in the first direction. This prevents the fixing belt 310 from moving toward the first full deviation position when the pressure rotation member 330 transitions from the contact state to the separated state. The fixing belt 310 thus tends to move toward the other end of the steering roller 350 even if the fixing belt 310 is located at the "near 1" to "near 3" positions and the pressure rotation member 330 transitions from the contact state to the separated state to increase the moving speed of the fixing belt 310 in the width direction. This can prevent the occurrence of a full deviation error when the pressure rotation member 330 transitions from the contact state to the separated state.

A case where the fixing belt 310 is located at the "far 1" to "far 3" positions when the last recording material before the separated state is conveyed to the fixing nip portion N will be described. If the fixing belt 310 is located at the "far 1" to "far 3" positions, B.P.now is any one of 5, 6, and 7. If the fixing belt 310 is located at any one of the "far 1" to "far 3" positions, the control unit 600 tilts the steering roller 350 in the second direction. The fixing belt 310 thus tends to move toward the one end of the steering roller 350 even if the fixing belt 310 is located at the "far 1" to "far 3" positions and the pressure rotation member 330 transitions from the contact state to the separated state to increase the moving speed of the fixing belt 310 in the width direction. This can prevent the occurrence of a full deviation error when the pressure rotation member 330 transitions from the contact state to the separated state.

The positions of the fixing belt 310 in the width direction at which the operation to tilt the steering roller 350 is performed in the second mode include positions closer to the "center" position than those in the first mode. This means that the positions of the fixing belt 310 in the width direction at which the operation to tilt the steering roller 350 is performed in the second mode are greater in number than those in the first mode. Specifically, in the present exemplary embodiment, the operation to tilt the steering roller 350 is performed at the "near 3" and "far 3" positions in the first mode. By contrast, in the second mode, the operation to tilt the steering roller 350 is performed at the "near 1", "near 2", and "near 3" positions and the "far 1", "far 2", and "far 3" positions.

Figure 10:
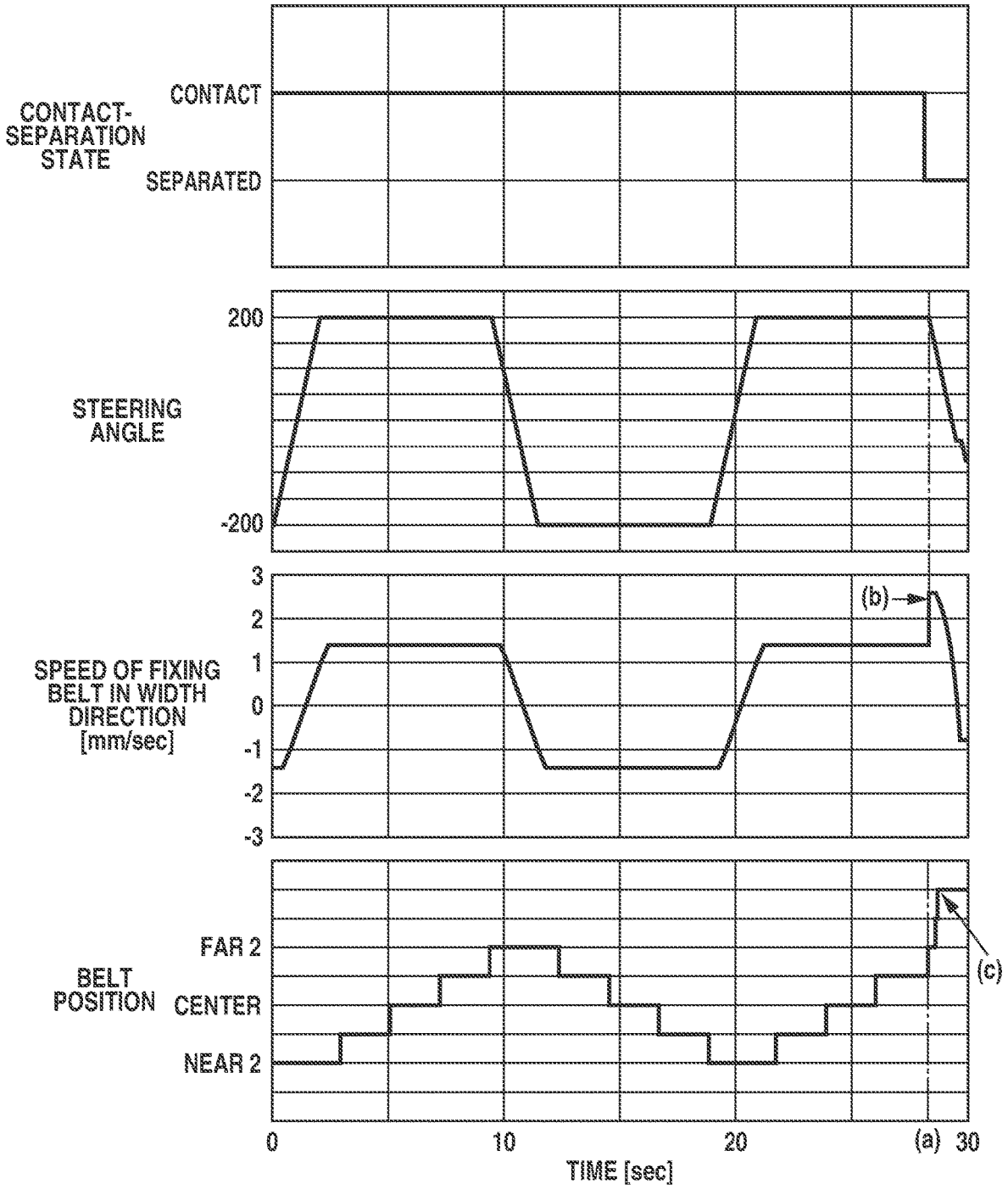
FIG. 10 is a diagram illustrating a relationship between the belt position, the moving speed of the fixing belt in the width direction, and the tilt angle of the steering roller according to a conventional example.

If the transition from the contact state to the separated state occurs with the fixing belt 310 located at a position close to a full deviation position, such as the "near 3" position and the "far 3" position (time (a) in FIG. 10), the moving speed of the fixing belt 310 in the width direction increases at the timing when the pressure rotation member 330 is separated (time (b) in FIG. 10). In such a case, the fixing belt 310 can reach the full deviation position. By contrast, in the present exemplary embodiment, the control unit 600 performs the operation to tilt the steering roller 350 such that the fixing belt 310 moves to the "center" position, at positions closer to the "center" position than are the "near 3" position and the "far 3" position (time (a) in FIG. 12). This can prevent the pressure rotation member 330 from transitioning from the contact state to the separated state when the fixing belt 310 is located at a position close to a full deviation position ("near 3" position or "far 3" position), and reduce the possibility for the fixing belt 310 to reach the full deviation position.

The steering roller 350 is tilted at angles A, −A, B, −B, C, and −C. In the first mode of steering control, the amount of change in the tilt angle of the steering roller 350 by one tilt operation is as much as between angles A and −A. By contrast, the second mode of steering control covers the cases where the amount of change in the tilt angle of the steering roller 350 by one tilt operation is small. Specifically, the steering roller 350 is tilted from angle A to one of angles B, C, −A, −B, and −C, and the steering angle of 0, or from angle −A to one of angles A, B, C, −A, −B, and −C, and the steering angle of 0. Except from angle A to angle −A and from angle −A to angle A, the amount of change in the tilt angle of the steering roller 350 by such a single tilt operation is smaller than between angles A and −A. The smaller amount of change in the tilt angle means that the tilt angle of the steering roller 350 is smaller than that of the steering roller 350 in the first mode. This reduces the moving speed of the fixing belt 310 in the width direction (between times (a) and (b) in FIG. 12). The reduced moving speed of the fixing belt 310 in the width direction can prevent the fixing belt 310 from reaching a full deviation position state at the timing of transition from the contact state to the separated state.

In the present exemplary embodiment, the control unit 600 performs the second mode of steering control at the timing when the last recording material before the separated state is conveyed to the fixing nip portion N. However, this is not restrictive.

If the control unit 600 performs the second mode of steering control at the timing when the last recording material before the separated state is conveyed to the fixing nip portion N, the first mode of steering control for reducing edge scratches is performed up to the last but one recording material before the separated state. In other words, the control unit 600 may perform the second mode of steering control at any timing, as long as the first mode of steering control for reducing edge scratches is performed up to the last but one recording material before the separated state. Specifically, the timing when the control unit 600 performs the second mode of steering control may be between sheets, i.e., between when the last but one recording material before the separated state passes through the fixing nip portion N and when the last recording material before the separated state reaches the fixing nip portion N.

Alternatively, the control unit 600 may perform the second mode of steering control while the last recording material before the separated state is passing through the fixing nip portion N. The control unit 600 may perform the second mode of steering control between sheets after the trailing edge of the last recording material before the separated state passes through the fixing nip portion N and before the pressure rotation member 330 is separated from the fixing belt 310. By performing the second mode of steering control after the last recording material before the separated state reaches the fixing nip portion N, the control unit 600 can reduce edge scratches to the fixing belt 310 as compared to the case where the second mode of steering control is performed when the last recording material before the separated state reaches the fixing nip portion N.

The separation of the pressure rotation member 330 from the fixing belt 310 increases the moving speed of the fixing belt 310 in the width direction. If the steering roller 350 is tilted to move the fixing belt 310 to the "center" position before the separation of the pressure rotation member 330 from the fixing belt 310, the moving speed of the fixing belt 310 in the width direction decreases. An increase in the moving speed of the fixing belt 310 in the width direction after the separation can thus be reduced as compared to the case where the fixing belt 310 is not moved to the "center" position before the separation. The fixing belt 310 can thereby be prevented from being fully deviated to either end of the steering roller 350 after the separation.

If a predetermined job has a short interval between sheets, the rotation speed of the fixing belt 310 in the conveyance direction when the pressure rotation member 330 is in the separated state is the same as the rotation speed of the fixing belt 310 when the pressure rotation member 330 is in the contact state. An example of the predetermined job is one including postprocessing, such as a stapling operation. If the rotation speed of the fixing belt 310 is reduced, it takes time to restore the original rotation speed of the fixing belt 310 when the separated state is switched to the contact state. If the time to restore the original rotation speed exceeds the time between sheets, the productivity drops accordingly. The rotation speed of the fixing belt 310 in the conveyance direction is therefore maintained the same between the contact state and the separated state. This can thus prevent the occurrence of a full deviation error without reducing the productivity.

<Second Mode According to Modification>

In the first exemplary embodiment, the operation to tilt the steering roller 350 is performed for the purpose of moving the fixing belt 310 to the "center" position when the last recording material before the separated state is conveyed to the fixing nip portion N.

In a modification, the purpose is to reduce the moving speed without changing the moving direction of the fixing belt 310 in the width direction. A detailed method for controlling the steering roller 350 will now be described. The steering control according to the modification differs from that of the first exemplary embodiment in the case where the fixing belt 310 is located at the "near 1" or "far 1" position when the last recording material before the separated state is conveyed to the fixing nip portion N. The case where the fixing belt 310 is located at the "near 1" or "far 1" position when the last recording material before the separated state is conveyed to the fixing nip portion N will thus be described.

In the modification, the "near 3" position will be referred to as a first predetermined position. The "near 1" position will be referred to as a second predetermined position. The "far 3" position will be referred to as a third predetermined position.

The control unit 600 determines whether the recording material conveyed to the fixing nip portion N is the last one before the separated state. If the recording material is the last one before the separated state, the sensor unit 390 detects the position of the fixing belt 310.

If the fixing belt 310 is located at the "near 3" position, the control unit 600 tilts the steering roller 350 at the first tilt angle. If the fixing belt 310 is located at the "far 3" position, the control unit 600 tilts the steering roller 350 at a second tilt angle.

If the fixing belt 310 is located at the "far 1" position and the control unit 600 determines that the steering roller 350 is tilted at angle A, the control unit 600 tilts the steering roller 350 at angle B or C, i.e., an angle smaller than angle A. This makes the moving speed of the fixing belt 310 in the width direction smaller than that in the case where the steering roller 350 is tilted at angle A. An increase in the moving speed of the fixing belt 310 in the width direction when the pressure rotation member 330 transitions from the contact state to the separated state can thereby be reduced. This can prevent the occurrence of a full deviation error.

If the fixing belt 310 is located at the "far 1" position and the control unit 600 determines that the steering roller 350 is tilted at angle −A, the control unit 600 tilts the steering roller 350 at angle −B or −C, i.e., an angle smaller than angle −A. This makes the moving speed of the fixing belt 310 in the width direction smaller than that in the case where the steering roller 350 is tilted at angle −A. An increase in the moving speed of the fixing belt 310 in the width direction when the pressure rotation member 330 transitions from the contact state to the separated state can thereby be reduced. This can thus prevent the occurrence of a full deviation error.

Similarly, if the fixing belt 310 is located at the "near 1" position and the control unit 600 determines that the steering roller 350 is tilted at angle −A, the control unit 600 tilts the steering roller 350 at angle −B or −C, i.e., an angle smaller than angle −A. This makes the moving speed of the fixing belt 310 in the width direction smaller than that in the case where the steering roller 350 is tilted at angle −A. An increase in the moving speed of the fixing belt 310 in the width direction when the pressure rotation member 330 transitions from the contact state to the separated state can thereby be reduced. This can thus prevent the occurrence of a full deviation error.

If the fixing belt 310 is located at the "near 1" position and the control unit 600 determines that the steering roller 350 is tilted at angle A, the control unit 600 tilts the steering roller 350 at angle B or C, i.e., an angle smaller than angle A. This makes the moving speed of the fixing belt 310 in the width direction smaller than that in the case where the steering roller 350 is tilted at angle A. An increase in the moving speed of the fixing belt 310 in the width direction when the pressure rotation member 330 transitions from the contact state to the separated state can thereby be reduced. This can thus prevent the occurrence of a full deviation error.

In the modification, if the fixing belt 310 is located at either the "far 1" position or the "near 1" position when the last recording material before the separated state is conveyed to the fixing nip portion N, the moving speed of the fixing belt 310 is reduced without changing the moving direction. The moving direction of the fixing belt 310 in the width direction is changed at the "near 3" position and the "far 3" position. The fixing belt 310 can thus be reciprocated over a wider range in the width direction than in the first exemplary embodiment. Deterioration to the surface of the fixing belt 310 due to edge scratches can thereby be reduced as compared to the first exemplary embodiment.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc™ (BD)), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-115511, filed Jul. 13, 2021, which is hereby incorporated by reference herein in its entirety.

What is claimed is:

1. An image forming apparatus comprising:

a fixing belt that is rotatable and endless;

a heating roller configured to make contact with an inner peripheral surface of the fixing belt and apply heat to the fixing belt;

a steering roller configured to make contact with the inner peripheral surface of the fixing belt along with the heating roller;

a pressure rotation member configured to press the fixing belt, wherein the pressure rotation member and the fixing belt are configured to form a nip portion and sandwich and convey a recording material, bearing unfixed toner, to the nip portion to fix an unfixed toner image to the recording material;

a contact-separation mechanism configured to move the pressure rotation member to a position where the pressure rotation member is in a contact state with the fixing belt and a position where the pressure rotation member is in a separated state from the fixing belt;

a belt position detection unit configured to detect a position of the fixing belt in a width direction of the fixing belt; and a control unit configured to control swing of the steering roller such that the fixing belt is moved to a predetermined position in the width direction of the fixing belt based on a detection result of the belt position detection unit, wherein, in continuously performing fixing on a plurality of recording materials, the control unit is configured to control the steering roller such that a distance between a center position of the fixing belt in the width direction of the fixing belt when an operation to tilt the steering roller is performed for a first time after the center position of the fixing belt is moved away from a center position of a moving range of the fixing belt and the center position of the moving range of the fixing belt is smaller in a period after a last but one recording material before the pressure rotation member enters the separated state passes through the nip portion than in a period before the recording material passes through the nip portion.

2. The image forming apparatus according to claim 1, wherein the belt position detection unit is configured to detect that the fixing belt is located at a first predetermined position, that the fixing belt is located at a second predetermined position, and that the fixing belt is located at a third predetermined position in the width direction of the fixing belt, wherein the center position of the fixing belt located at the first predetermined position and the second predetermined position falls on one end side of the steering roller with respect to a center of the steering roller in the width direction of the fixing belt, wherein the center position of the fixing belt located at the first predetermined position falls on the one end side of the center position of the fixing belt located at the second predetermined position, wherein the center position of the fixing belt located at the third predetermined position falls on the other end side of the steering roller with respect to the center of the steering roller in the width direction of the fixing belt, wherein the steering roller is configured to move to a first tilt angle and a second tilt angle, wherein the first tilt angle is an angle at which the steering roller is tilted in a first direction that is a predetermined direction, wherein the second tilt angle is an angle at which the steering roller is tilted in a second direction opposite to the first direction, wherein the control unit is configured to control the steering roller in a first mode and a second mode, wherein, before the last but one recording material before the pressure rotation member enters the separated state passes through the nip portion, the control unit is configured to control the steering roller in the first mode, wherein, after the last but one recording material before the pressure rotation member enters the separated state passes through the nip portion, the control unit is configured to control the steering roller in the second mode, wherein, in the first mode, the control unit is configured to (i) perform an operation to tilt the steering roller at the first tilt angle if the fixing belt is detected to be located at the first predetermined position, (ii) not perform the operation to tilt the steering roller if the fixing belt is detected to be located at the second predetermined position, and (iii) perform an operation to tilt the steering roller at the second tilt angle if the fixing belt is detected to be located at the third predetermined position, and wherein, in the second mode, the control unit is configured to (iv) perform the operation to tilt the steering roller at the first tilt angle if the fixing belt is detected to be located at the first predetermined position, (v) perform the operation to tilt the steering roller at the second tilt angle if the fixing belt is detected to be located at the third predetermined position, (vi) perform an operation to tilt the steering roller in the first direction at a tilt angle smaller than the first tilt angle if the steering roller is tilted at the first tilt angle and the fixing belt is detected to be located at the second predetermined position, and (vii) perform an operation to tilt the steering roller in the second direction at a tilt angle smaller than the second tilt angle if the steering roller is tilted at the second tilt angle and the fixing belt is detected to be located at the second predetermined position.

3. The image forming apparatus according to claim 1, wherein the belt position detection unit is configured to detect that the fixing belt is located at a first predetermined position, that the fixing belt is located at a second predetermined position, and that the fixing belt is located at a third predetermined position in the width direction of the fixing belt, wherein the center position of the fixing belt located at the first predetermined position and the second predetermined position falls on one end side of the steering roller with respect to a center of the steering roller in the width direction of the fixing belt, wherein the center position of the fixing belt located at the first predetermined position falls on the one end side of the center position of the fixing belt located at the second predetermined position, wherein the center position of the fixing belt located at the third predetermined position falls on the other end side of the steering roller with respect to the center of the steering roller in the width direction of the fixing belt, wherein the steering roller is configured to move to a first tilt angle and a second tilt angle, wherein the first tilt angle is an angle at which the steering roller is tilted in a first direction that is a predetermined direction, wherein the second tilt angle is an angle at which the steering roller is tilted in a second direction opposite to the first direction, wherein the control unit is configured to control the steering roller in a first mode and a second mode, wherein, before the last but one recording material before the pressure rotation member enters the separated state passes through the nip portion, the control unit is configured to control the steering roller in the first mode, wherein, after the last but one recording material before the pressure rotation member enters the separated state passes through the nip portion, the control unit is configured to control the steering roller in the second mode, wherein, in the first mode, the control unit is configured to (i) perform an operation to tilt the steering roller at the first tilt angle if the fixing belt is detected to be located at the first predetermined position, (ii) not perform the operation to tilt the steering roller if the fixing belt is detected to be located at the second predetermined position, and (iii) perform an operation to tilt the steering roller at the second tilt angle if the fixing belt is detected to be located at the third predetermined position, and wherein, in the second mode, the control unit is configured to (iv) perform the operation to tilt the steering roller at the first tilt angle if the fixing belt is detected to be located at the first predetermined position, (v) perform the operation to tilt the steering roller at the second tilt angle if the fixing belt is detected to be located at the third predetermined position, (vi) perform an operation to tilt the steering roller in the first direction at a tilt angle smaller than the first tilt angle if the steering roller is tilted at the first tilt angle and the fixing belt is detected to be located at the second predetermined position, and (viii) perform the operation to tilt the steering roller in the first direction at the tilt angle smaller than the first tilt angle if the steering roller is tilted at the second tilt angle and the fixing belt is detected to be located at the second predetermined position.

4. The image forming apparatus according to claim 1, wherein in a predetermined job, a rotation speed of the fixing belt when the pressure rotation member is in the separated state is the same as that of the fixing belt with the pressure rotation member is in the contact state.

5. The image forming apparatus according to claim 1, wherein, if the first mode is switched to the second mode, the control unit is configured to start an operation to tilt the steering roller in the second mode when a last recording material before the pressure rotation member enters the separated state reaches the nip portion.

6. An image forming apparatus comprising:

a fixing belt that is rotatable and endless;

a heating roller configured to make contact with an inner peripheral surface of the fixing belt and apply heat to the fixing belt;

a steering roller configured to make contact with the inner peripheral surface of the fixing belt along with the heating roller;

a pressure rotation member configured to press the fixing belt, wherein the pressure rotation member and the fixing belt are configured to form a nip portion and sandwich and convey a recording material, bearing unfixed toner, to the nip portion to fix an unfixed toner image to the recording material;

a contact-separation mechanism configured to move the pressure rotation member to a position where the pressure rotation member is in a contact state with the fixing belt and a position where the pressure rotation member is in a separated state from the fixing belt;

a belt position detection unit configured to detect a position of the fixing belt in a width direction of the fixing belt; and a control unit configured to control swing of the steering roller such that the fixing belt is moved to a predetermined position in the width direction of the fixing belt based on a detection result of the belt position detection unit, wherein, in continuously performing fixing on a plurality of recording materials, the control unit is configured to control the steering roller such that a distance between a center position of the fixing belt when an operation to tilt the steering roller is performed for a first time after the center position of the fixing belt is moved away from a center position of a moving range of the fixing belt in the width direction of the fixing belt and the center position of the moving range of the fixing belt is smaller in a period after a trailing edge of a last recording material before the pressure rotation member enters the separated state passes through the nip portion than in a period before the trailing edge of the recording material passes through the nip portion.

7. An image forming apparatus comprising:

a fixing belt that is rotatable and endless;

a heating roller configured to make contact with an inner peripheral surface of the fixing belt and apply heat to the fixing belt;

a steering roller configured to make contact with the inner peripheral surface of the fixing belt along with the heating roller;

a pressure rotation member configured to press the fixing belt, wherein the pressure rotation member and the fixing belt are configured to form a nip portion and sandwich and convey a recording material, bearing unfixed toner, to the nip portion to fix an unfixed toner image to the recording material;

a contact-separation mechanism configured to move the pressure rotation member to a position where the pressure rotation member is in a contact state with the fixing belt and a position where the pressure rotation member is in a separated state from the fixing belt;

a belt position detection unit configured to detect a position of the fixing belt in a width direction of the fixing belt, wherein the belt position detection unit is configured to detect that the fixing belt is located at a first predetermined position and that the fixing belt is located at a second predetermined position in the width direction of the fixing belt; and a control unit configured to control swing of the steering roller such that the fixing belt is moved to a predetermined position in the width direction of the fixing belt based on a detection result of the belt position detection unit, wherein a center position of the fixing belt located at the first predetermined position and the second predetermined position falls on one end side of the steering roller with respect to a center of the steering roller in the width direction of the fixing belt, wherein the center position of the fixing belt located at the first predetermined position falls on the one end side of the center position of the fixing belt located at the second predetermined position, wherein the control unit is configured to control the steering roller in a first mode and a second mode, wherein, if the pressure rotation member is in the contact state, the control unit is configured to control the steering roller in the first mode, wherein, in the first mode, the control unit is configured to perform an operation to tilt the steering roller in a first direction if the fixing belt is detected to be located at the first predetermined position, and not perform an operation to tilt the steering roller if the fixing belt is detected to be located at the second predetermined position, wherein, in the second mode, the control unit is configured to perform the operation to tilt the steering roller in the first direction if the fixing belt is detected to be located at the second predetermined position, and wherein, if the pressure rotation member transitions from the contact state to the separated state, the control unit is configured to switch control of the steering roller from the first mode to the second mode before an operation to separate the pressure rotation member from the fixing belt is started, and is configured to start an operation to tilt the steering roller in the second mode.

* * * * *